US010842280B2

(12) United States Patent
Powicki

(10) Patent No.: US 10,842,280 B2
(45) **Date of Patent: *Nov. 24, 2020**

(54) THERAPEUTIC BACK SUPPORT AND STABILIZATION

(71) Applicant: ACCESS ENTERPRISE, LLC, Shrewsbury, MA (US)

(72) Inventor: Mark Powicki, Hingham, MA (US)

(73) Assignee: Access Enterprise, LLC, Shrewsbury, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/371,938

(22) Filed: Apr. 1, 2019

(65) Prior Publication Data

US 2019/0313801 A1 Oct. 17, 2019

Related U.S. Application Data

(63) Continuation of application No. 14/853,814, filed on Sep. 14, 2015, now Pat. No. 10,271,659, which is a continuation of application No. 14/101,322, filed on Dec. 9, 2013, now Pat. No. 9,167,903, which is a continuation of application No. 12/456,068, filed on Jun. 10, 2009, now Pat. No. 8,616,641, which is a continuation-in-part of application No. 11/542,888, filed on Oct. 4, 2006, now abandoned.

(60) Provisional application No. 61/204,473, filed on Jan. 7, 2009, provisional application No. 61/197,509, filed on Oct. 27, 2008.

(51) Int. Cl.

| | |
|---|---|
| ***A47C 7/40*** | (2006.01) |
| ***A47C 7/44*** | (2006.01) |
| ***A47C 1/023*** | (2006.01) |
| ***A47C 7/46*** | (2006.01) |

(52) U.S. Cl.
CPC ..... *A47C 7/40* (2013.01); *A47C 1/023* (2013.01); *A47C 7/44* (2013.01); *A47C 7/462* (2013.01)

(58) Field of Classification Search
CPC .. A47C 1/023; A47C 7/40; A47C 7/42; A47C 7/44; A47C 7/462
See application file for complete search history.

(56) References Cited

U.S. PATENT DOCUMENTS

| | | | | |
|---|---|---|---|---|
| 1,271,636 A * | 7/1918 | Walton | A47C 1/03205 | 297/319 |
| 2,328,243 A * | 8/1943 | Wood | A47C 7/443 | 297/301.4 |
| 2,329,673 A * | 9/1943 | Wood | A47C 1/026 | 297/303.5 |
| 3,720,442 A * | 3/1973 | Bergmann | A47C 1/023 | 297/344.18 |
| 4,032,189 A * | 6/1977 | Benavente | B62J 1/28 | 297/352 |
| 4,085,967 A * | 4/1978 | Spencer | A47C 9/02 | 297/115 |
| 4,102,549 A * | 7/1978 | Morrison | A47C 1/023 | 297/353 |

(Continued)

*Primary Examiner* — Philip F Gabler
(74) *Attorney, Agent, or Firm* — Bergman LLC; Michael Bergman

(57) ABSTRACT

A therapeutic back support device including a back support portion that automatically and repeatedly moves forward to maintain engagement with a user's back as the user moves forward with respect to a chair seat. The back support portion substantially resists backward motion and provides substantially continuous therapeutic support to the user's spine pending a release signal.

4 Claims, 18 Drawing Sheets

(56) References Cited

U.S. PATENT DOCUMENTS 4,170,382 A * 10/1979 Wheeler ..... A47C 7/443 297/300.5
4,307,913 A * 12/1981 Spiegelhoff ..... A47C 1/03 297/411.33
4,362,335 A * 12/1982 Drabert ..... A47C 7/441 248/575
4,601,074 A * 7/1986 Welsch ..... A47C 17/161 297/112
4,872,727 A * 10/1989 Rye ..... A47C 1/03 297/411.36
5,404,604 A * 4/1995 Has ..... A47C 20/041 5/617
5,511,852 A * 4/1996 Kusiak ..... A47C 1/023 297/301.4
5,580,127 A * 12/1996 Piretti ..... A47C 3/04 297/291
5,599,066 A * 2/1997 Chih ..... B60N 2/0284 297/383
5,599,906 A * 2/1997 Dasmahapatra ..... C12N 15/62 530/350
5,660,439 A * 8/1997 Unwalla ..... A47C 1/03255 297/300.2
5,839,784 A * 11/1998 Breen ..... A47C 1/03 297/383
5,902,013 A * 5/1999 Hong ..... A47C 1/023 248/429
5,951,109 A * 9/1999 Roslund, Jr. ..... A47C 1/03255 297/299
6,095,606 A * 8/2000 Opsvik ..... A47C 7/402 297/340
6,386,631 B1 * 5/2002 Masuda ..... B60N 2/4221 297/216.1
7,222,920 B1 * 5/2007 Washington ..... A47C 1/023 297/353
7,401,858 B2 * 7/2008 Lee ..... A47C 7/40 297/316
8,616,641 B2 * 12/2013 Powicki ..... A47C 1/023 297/301.6
9,167,903 B2 * 10/2015 Powicki ..... A47C 1/023
10,271,659 B2 * 4/2019 Powicki ..... A47C 1/023
2003/0230918 A1 * 12/2003 Serber ..... A47C 1/022 297/313

* cited by examiner

THERAPEUTIC BACK SUPPORT AND STABILIZATION

The present application is a continuation of U.S. patent application Ser. No. 14/853,814, filed on Sep. 14, 2015 (now issued as U.S. Pat. No. 10,271,659). Application Ser. No. 14/853,814 is a continuation of U.S. patent application Ser. No. 14/101,322, filed on Dec. 9, 2013 (now issued as U.S. Pat. No. 9,167,903 on Oct. 27, 2015). Application Ser. No. 14/101,322 is a continuation of U.S. patent application Ser. No. 12/456,068 filed Jun. 10, 2009 (issued as U.S. Pat. No. 8,616,641 on Dec. 31, 2013) which is a continuation-in-part of U.S. patent application Ser. No. 11/542,888 filed on Oct. 4, 2006, and application Ser. No. 12/456,068 further claims the benefit of U.S. provisional patent application No. 61/197,509 filed Oct. 27, 2008 and U.S. provisional patent application 61/204,473 filed Jan. 7, 2009. The disclosures of all the foregoing are herein incorporated by reference in their entireties in the present application.

BACKGROUND

It is widely acknowledged that the level and nature of physical activity experienced by individuals in and out of the workplace is changing. In particular, the rapid expansion of knowledge work and automation in the workplace has resulted in changes in the physical and physiological demands of many jobs. In like fashion, leisure activities and avocations increasingly involve, for example, operating the user interface of a computer or other equipment. While it is widely understood that these changes in the nature of a portion of such human activities have an affect on physiology and health, understanding remains, in some ways, rudimentary. Consequently, despite vigorous efforts by skilled practitioners to improve worker support technology, including seating technology, significant limitations of that technology remain.

One type of conventional chair includes a seat, a backrest, a base, and armrests. An occupant of the conventional chair sits on an upper surface of the seat. The seat is supported by the base. The occupant typically rests his or her back against the backrest.

The backrest is typically utilized to provide back support to the occupant of a chair. The backrest allows the occupant of the chair to rest his or her back against the backrest, thereby alleviating excess strain.

With some conventional chairs, a user is able to modify the horizontal position of the backrest by adjusting a knob or another similar controller.

With other conventional chairs, the chair has a reclining (i.e., tilting) backrest that is configured to tilt back when an occupant leans against the backrest and to tilt forward to an upright position when an occupant leans forward.

SUMMARY

Certain conventional chairs have an adjustment knob that allows a user to set a depth of the chair. However, such chairs are not automatically configurable. Thus, when the occupant slides forward in the chair (e.g., out of habit, to reach forward for something, or to use a computer), the backrest will no longer be positioned against the occupant's back, and the occupant will lack back support until he or she moves back in the chair. Therefore, such a chair does not allow for sufficient spinal contact/support in respect to the occupant in a continuous manner. If the occupant remains in the forward position without back support for too long, he or she is placing cumulative postural stress on the cervical, thoracic, and lumbar spine which can manifest over time into spinal pathologies/overuse injuries.

Such a lack of proper spinal support also fatigues the muscles that support the spine, therefore leading to the above referenced injuries. Examples of possible injuries caused by this lack of spinal support include cervical strains, headaches, muscle aches, and upper trapezial strains. Furthermore, individuals with degenerative spinal conditions can exacerbate their symptoms, such as joint pain and spinal radiculopathies.

As another example, both of the aforementioned conventional chairs also suffer from the drawback that the backrest is only positionable as far forward as the rear edge of the seat, so that if the user wishes to sit very far forward in the conventional chair, he or she will be unable to have spinal contact/support unless he or she purchases a chair with a smaller seat. Reclining conventional chairs suffer this drawback because the backrest is positioned adjacent the rear of the seat and only tilts up into an upright position.

Reclining conventional chairs also suffer the drawback that as a user slides forward or backward in the conventional chair, the backrest will become tilted at an angle with respect to the user's back/spine and will therefore fail to provide sufficient spinal contact/support.

Although some conventional chairs may stay in contact with the user's back to some degree, they do not provide therapeutic support and stabilization for the user's spine. Consequently the user is able to slouch or otherwise achieve a non-advantageous spinal position that leads to cumulative stress and fatigue of the back.

In contrast to the above-described conventional approaches, embodiments of the present invention provide an improved chair having an automatically adjusting sliding back portion. A chair according to the present invention dictates a position and orientation of the user's spine and provides therapeutic support and stabilization to the curvatures of the spine to maintain an upright posture. The user manually sets an initial depth of the chair and as the user slides forward in the chair (whether intentionally or not) a biasing mechanism automatically slides the back portion forward to remain flush against the occupant's back, thus providing optimal support and stabilization for the user's spine. The back portion may be configurable to slide forward of the rear edge of the seat in order to provide a greater range of positions. This allows the occupant to slide very far forward in the chair and still maintain sufficient spinal contact/support.

Further embodiments of the invention include a back portion that is configurable to tilt so that the occupant may adjust the tilt of the back portion to match the desired tilt of the occupant's back. As the seat slides forward, this tilt is maintained.

A further embodiment includes placing armrests on the chair such that the armrests slide together with respect to the excursion of anterior/posterior motion of the back portion. The armrests may also be configured to fold out and away from the seat when the user does not desire to rest his or her arms. The armrests are also capable of adjusting up or down with respect to the occupant's height/elbow level.

BRIEF DESCRIPTION OF THE DRAWINGS

The foregoing and other objects, features, and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

The following description is provided to enable any person skilled in the art to make and use the disclosed invention and sets forth the best modes presently contemplated by the inventors of carrying out their invention. In the following description, for purposes of explanation, numerous specific details are set forth in order to provide a thorough understanding of the present invention. It will be apparent to the creative practitioner of ordinary skill in the art, however, that the present invention may be practiced without these specific details. In other instances, well-known structures and devices are shown in schematic or block diagram form in order to avoid unnecessarily obscuring the present inventions.

It should be noted that, while the various figures show respective aspects of the invention, no one figure is intended to show the entire invention. Rather, the figures together illustrate the invention in its various aspects and principles. As such, it should not be presumed that any particular figure is exclusively related to a discrete aspect or species of the invention. To the contrary, one of skill in the art would appreciate that the figures taken together reflect various embodiments exemplifying the invention.

According to illustrative embodiments, principles of the invention are shown with respect to chairs having back portions that are forward biased to provide sufficient spinal contact/support to the occupant even as the occupant slides forward in the chair. Unlike some conventional chairs which may stay in contact with a user's back to some degree, a back support according to the present invention provides optimal therapeutic support and stabilization by maintaining an upright position and orientation of the user's spine, and by resisting rearward motion in a substantially inelastic fashion until actively released. Consequently the user is prevented from slouching or otherwise achieving a non-advantageous spinal position that leads to cumulative stress and fatigue of the back.

The occupant may set an initial location for the back portion, and as he or she slides forward in the chair, the back portion will slide forward together with the occupant's back. This prevents the occupant from losing back support as soon as he or she slides forward in the chair, which he or she may do unconsciously out of habit. Therefore, the invention allows the occupant to sit comfortably for an extended period of time with therapeutic back support. The invention is also directed to a method for providing such back support.

Figure 1B:
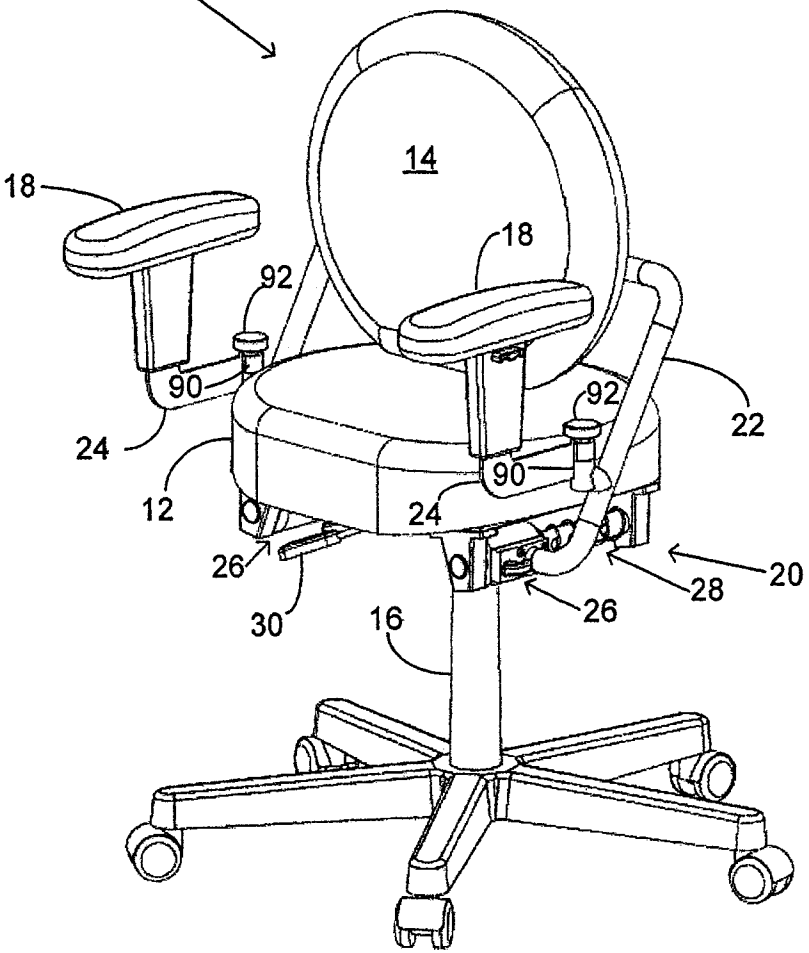
FIG. 1B is a profile (e.g., offset) view of the chair of FIG. 1A with the backrest in a forward position.
Figure 1A:
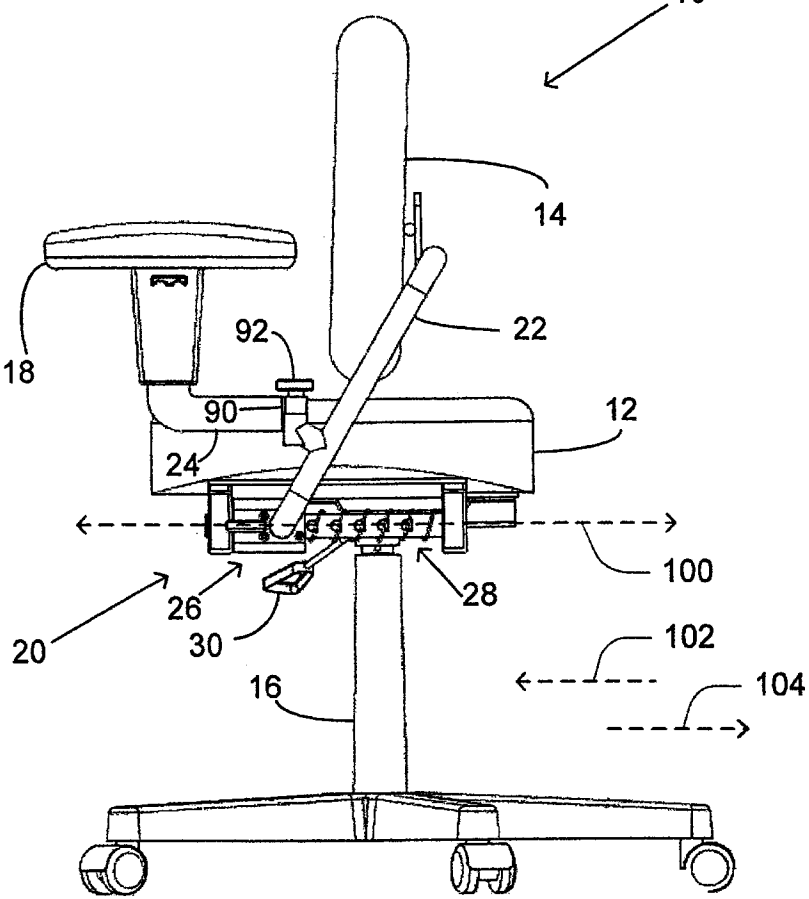
FIG. 1A is a side view of a chair with a backrest in a forward position.

FIGS. 1A and 1B show certain aspects of a chair 10 according to one embodiment of the invention. As shown, chair 10 includes a seat portion 12, a back portion 14, and a positioner 20. In the illustrated embodiment, the chair 10 includes a base 16 and armrests 18. The positioner 20 includes a controller 26 and a guiding element 28. The back portion 14 connects to the controller 26 by means of a connecting bar 22. The armrests connect to the connecting bar 22 by means of a secondary connector bar 24. The secondary connector bar 24 is hinged so as to rotate around the hinge 90 near the primary connecting bar 22 as described in further detail below.

The controller 26 is configured to slide along the guiding element 28, which is placed along a translational axis 100. The controller 26 also includes a forward-biasing mechanism (such as, for example, a spring), so that it will slide in a forward direction 102 along the translational axis 100 until it reaches the front of the guiding element 28 as long as no force is applied against the back portion 14. The forward-biasing mechanism will be discussed below.

When no one is occupying the chair 10, no force is applied against the back portion 14 in a backward direction 104, so the forward-biasing mechanism will push the controller 26 all the way to the front of the guiding element 28. This causes the back portion 14 to be pushed as far in a forward direction 102 as possible as well, as depicted in FIGS. 1A and B. The range of motion of the back portion 14 may vary by design, but in one embodiment, when the back portion 14 is in the most forward position, it will be located halfway between the front and the back of the seat portion 12. However, other embodiments are possible, with the back portion 14 extending even further forward or possibly less far forward, depending on the needs of the intended occupants of the chair 10. For example, the physical characteristics and common sitting habits of the intended occupants may be taken into consideration in making this determination.

Figure 2:
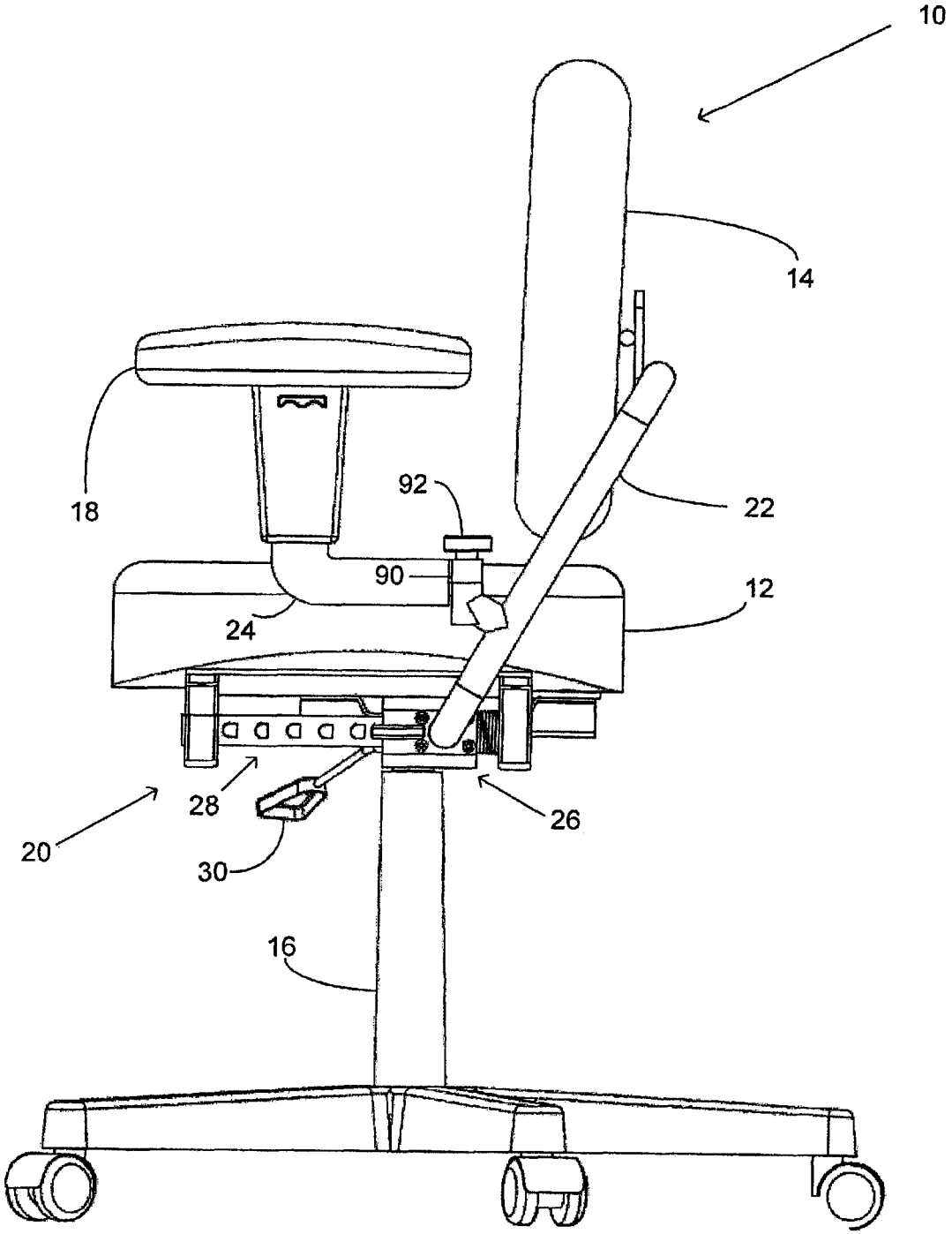
FIG. 2 is a side view of the chair of FIG. 1A with the backrest in the rearmost position.

When a user wishes to sit in the chair 10, he or she may wish to position the back portion 14 further back so as to be able to sit further back in the chair 10. This procedure will be discussed below, but FIG. 2 depicts the chair 10 with the back portion 14 and the controller 26 pushed all the way in the backward direction 104. The range of motion of the back portion 14 may vary by design, but in one embodiment, when the back portion 14 is in the most rearward position, it will be located directly above the rear edge of the seat portion 12. However, other embodiments are possible, with the back portion 14 extending even further rearward or possibly less far rearward, depending on the needs of the intended occupants of the chair 10. For example, the physical characteristics and common sitting habits of the intended occupants may be taken into consideration in making this determination.

Figure 5B:
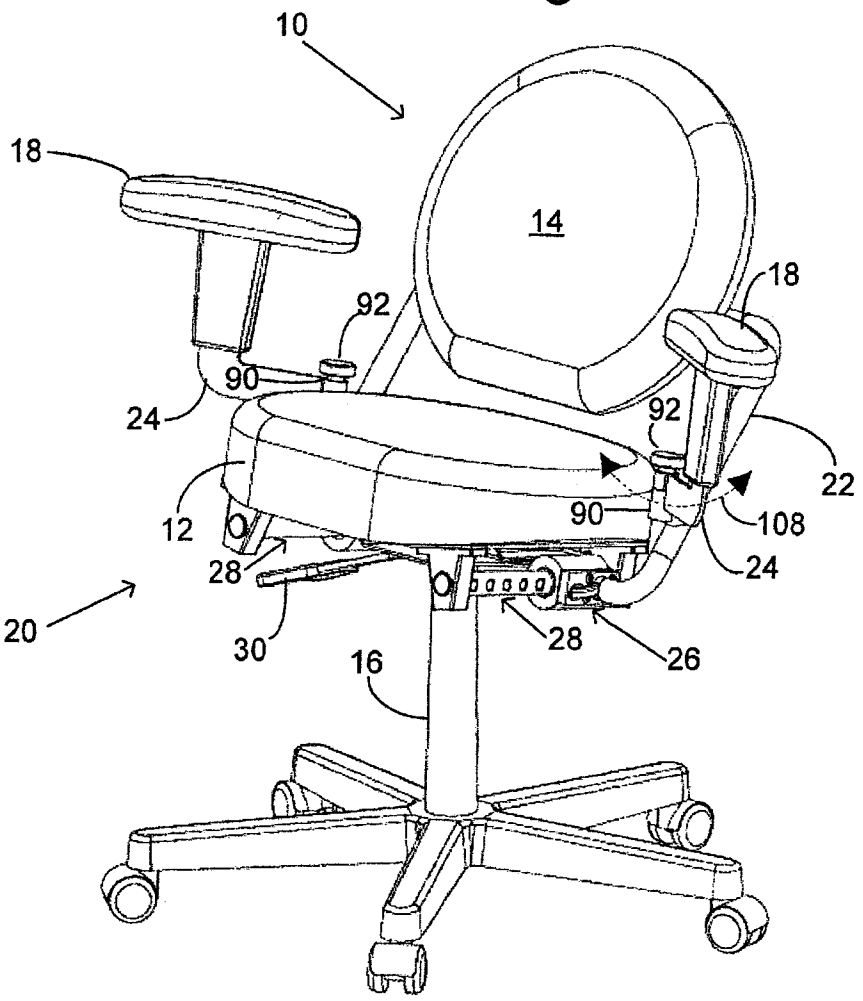
FIGS. 5A and 5B show the chair of FIG. 1A with the backrest tilted and the armrest swung out. Additional backrest tilting features are also shown. The seat portion is also tilted in this depiction.

In an alternative embodiment, depicted in FIGS. 1B and 5B, the chair 10 may have two controllers 26 and two guiding elements 28, as well as two sets of connecting bars 22, 24. In this embodiment, there are two redundant positioners 20 for the chair 10. This arrangement is useful because it allows the occupant to control the chair 10 with either hand. It further produces less strain on each controller 26 and guiding element 28.

Figure 3B:
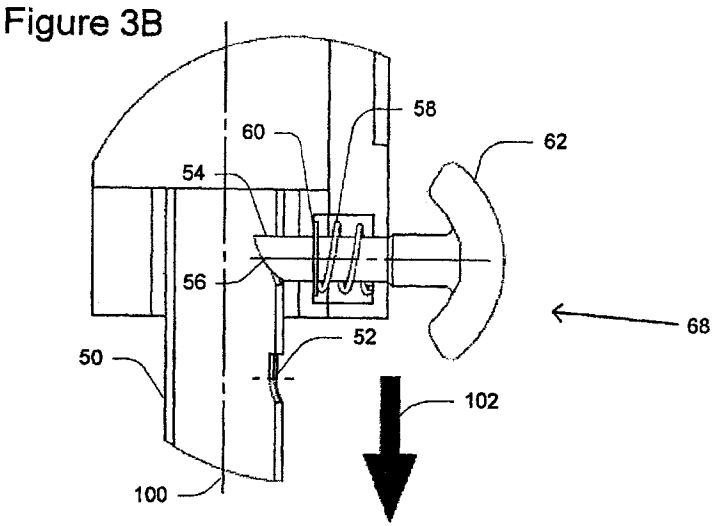
FIG. 3B is a detailed diagram illustrating a pull handle component of the controller of FIG. 3A with the locking pin engaged.
Figure 3A:
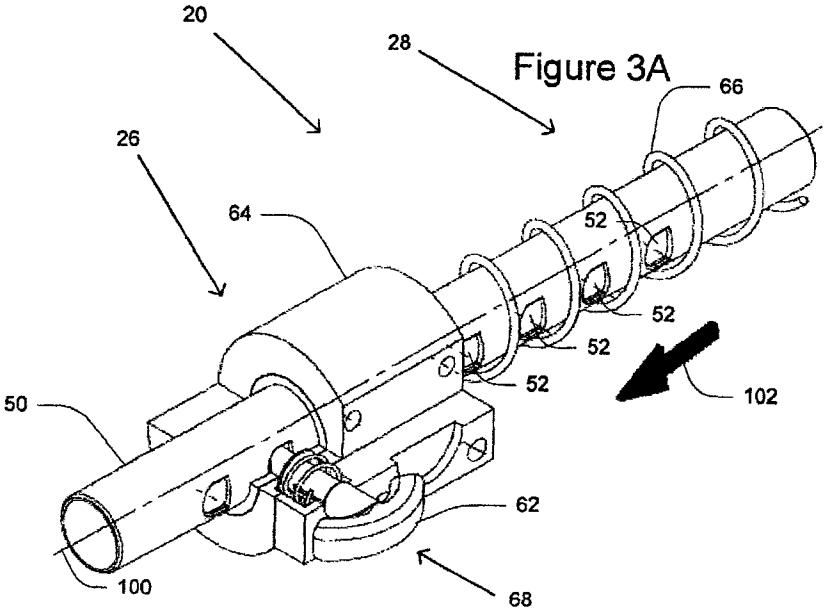
FIG. 3A is a detailed diagram of a positioner as in FIG. 1A with a locking pin engaged.

FIG. 3A depicts one embodiment of the controller 26 and guiding element 28 in more detail. The guiding element includes a hollow pipe 50 having a series of holes or notches 52 positioned thereon along the translational axis 100. The controller 26 has a bushing assembly 64, and a pin assembly 68.

As depicted in detail in FIG. 3B, the pin assembly 68 includes a pull handle 62, a pin 54, having a radius nose 56, a light compression spring 58, which surrounds the pin 54, and a retaining ring 60. Returning to FIG. 3A, the forward-biasing mechanism of the controller 26 is provided by a biasing spring 66 positioned around the pipe 50 behind the bushing assembly 64. The pin 54 is configured to slide into any of the holes 52 on the pipe 50 as the controller 26 traverses each hole 52.

Figure 4B:
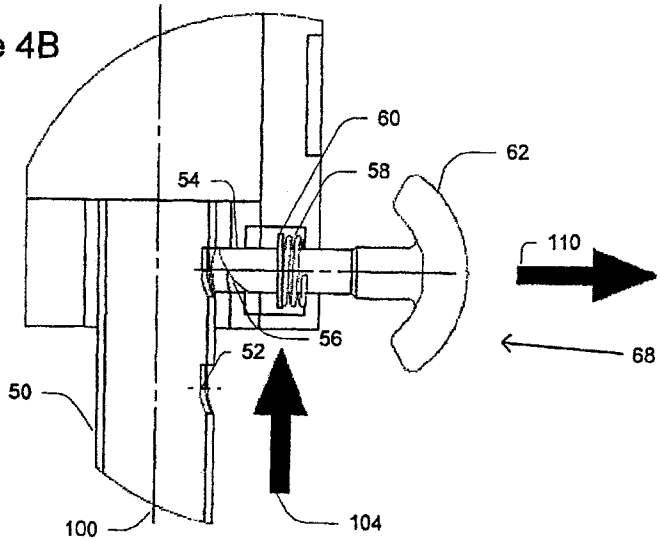
FIG. 4B is a detailed diagram illustrating the pull handle component of the controller of FIG. 3A with the locking pin disengaged.
Figure 4A:
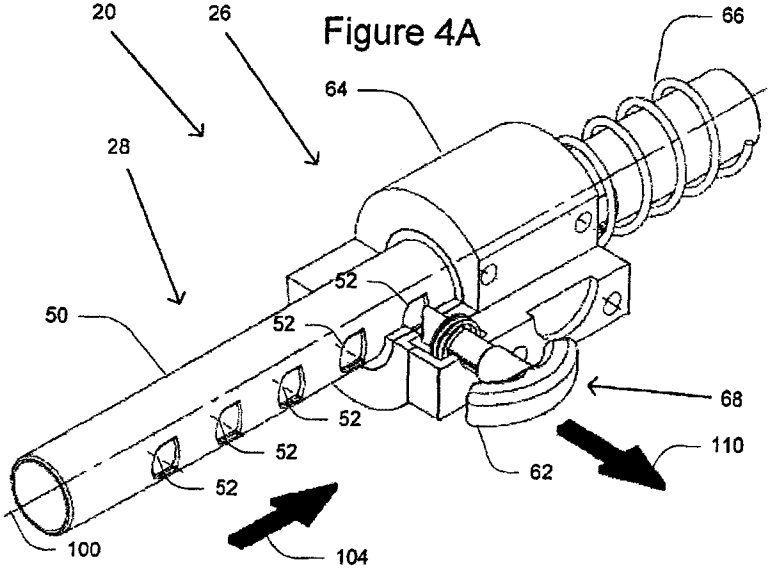
FIG. 4A is a detailed diagram of the positioner of FIG. 3A with the locking pin disengaged.

As depicted in FIGS. 4A and 4B, when the pull handle 62 is pulled in an outward direction 110 away from the pipe 50, the pin 54 is removed from the hole 52 that it was inserted into, and the user is then able to apply pressure in a rearward direction 104 to the back portion 14 (see FIG. 1A) in order to slide the controller 26 along the pipe 50 in the rearward direction 104. When the user ceases to push back and releases the pull handle 62, the light compression spring 58 pushes against the retaining ring 60, which pushes the pin 54 back towards the pipe 50 and the pin 54 engages into a hole 52. As long as the user retains his or her position in the chair 10, the back portion 14 should remain flush against the user's back, thereby providing spinal contact/support.

However, as the user slides forward in the seat portion 12, the force applied by the biasing spring 66 will no longer be counteracted by the force of the user's back, and the back portion 14 will translate forward. As depicted in FIG. 3B, the radius nose ending 56 of the pin 54 is curved such that when a force in a forward direction 102 is applied to the pin 54, the pin 54 will slip out of any hole 52 in which it is positioned. However, a force in the rearward direction 104 will not cause the pin to slip out of the hole 52. Therefore, as the user slides forward in the seat, the force of the biasing spring 66 will push the controller 26 in a forward direction 102 along the pipe, and the pin 54 will slip out of the hole 52 that it is in and reposition in another hole 52 further forward along the pipe 50 until the force of the user's back counteracts the force of the biasing spring 66 again. As the controller 26 slides in the forward direction 102, the connecting bar forces the back portion 14 to also slide in the forward direction 102, allowing the back portion 14 to remain flush against the user's back, thereby providing spinal contact/support. A chair according to the present invention dictates a position and orientation of the user's spine and provides therapeutic support and stabilization to the curvatures of the spine to maintain an upright posture.

Figure 5A:
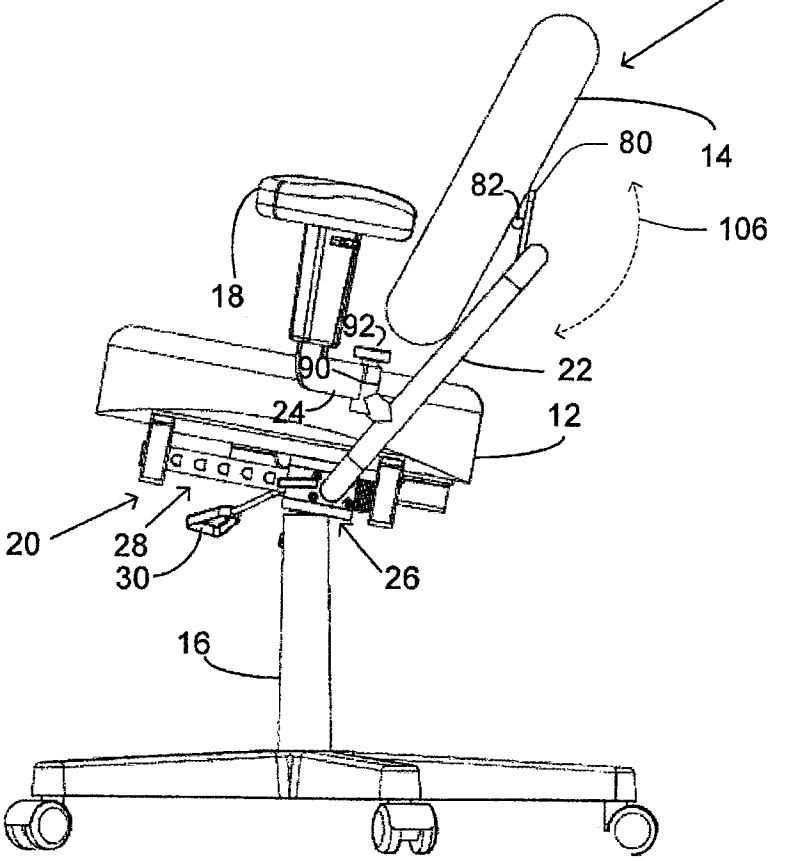

In one embodiment, the back portion 14 is configurable to tilt to conform to the desired degree of tilt of the user's back. FIG. 5A depicts a tilting control element 80 and a tilting hinge 82. The tilting control element 80 may be activated to allow the back portion 14 to rotate around the tilting hinge 82, as depicted by the arc 106. When the tilting element 80 is deactivated, the tilting hinge 82 locks, and the back portion 14 ceases to rotate around the hinge 82. FIG. 1A depicts the back portion 14 in an upright position. FIG. 5A depicts the back portion 14 in a tilted position.

In one embodiment, the armrests 18 are configurable to swing away from the seat portion 12. FIGS. 1A, 1B, 5A, and 5B depict hinges 90 on the secondary connector bar 24 as well as armrest control elements 92. When the armrests 18 are positioned in an inward fashion, as depicted in FIG. 1A, the armrests 18 lock into place. When a user activates the armrest control element 92, the armrests 18 unlock, and the user may swing the armrests away from the seat 12 along arc 108 around armrest hinge 90. When this happens, the armrests 18 will lay out away from the seat 14, as depicted in FIGS. 5A and 5B.

FIGS. 5A and 5B also depict the chair 10 with the seat portion 12 tilted backwards relative to the base 16.

Figure 6:
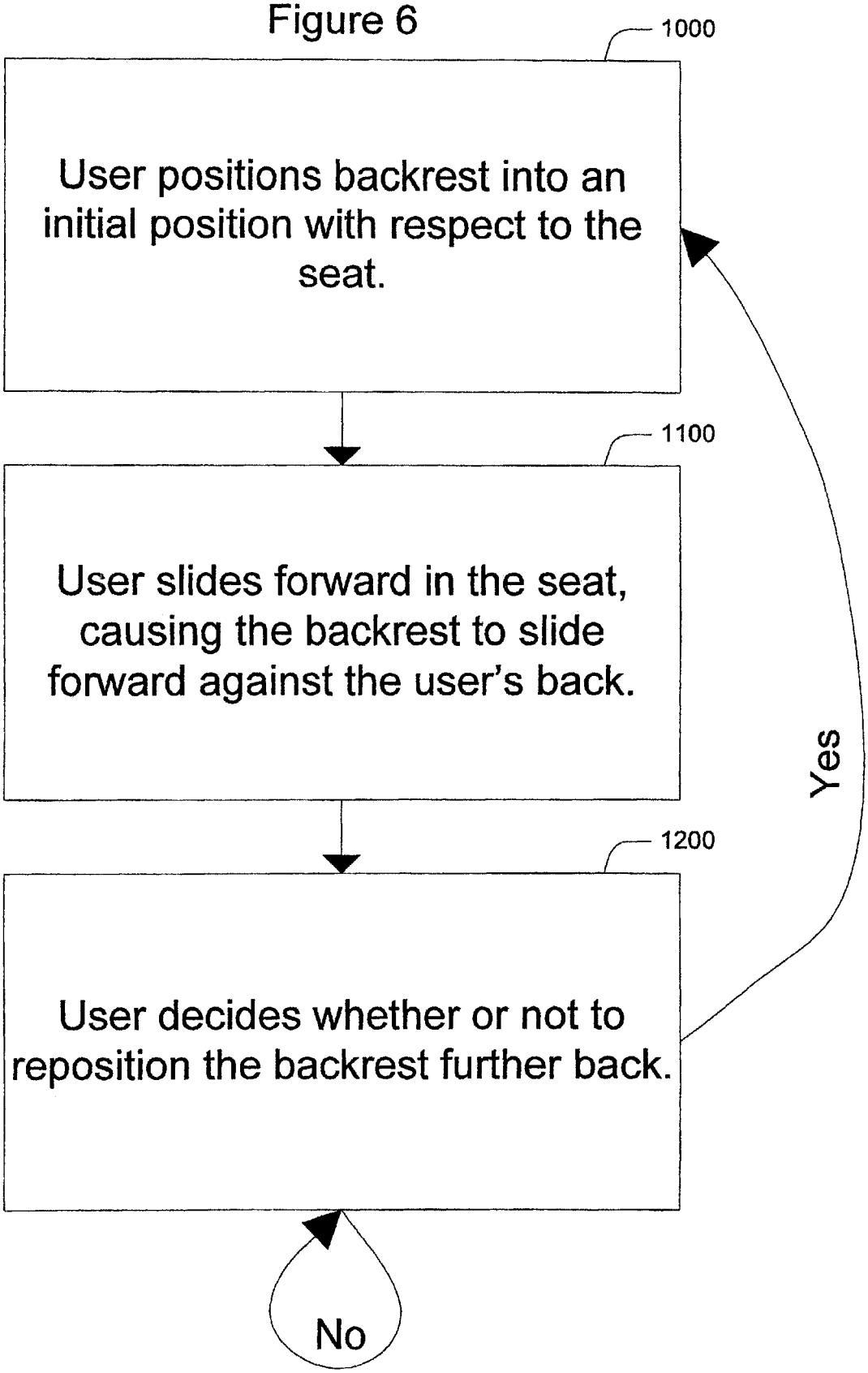
FIG. 6 is a flowchart showing a method of operating the chair.

FIG. 6 is a flowchart which illustrates a method for controlling a back portion 14 of a chair 10, as described above. In step 1000 the user positions the back portion in an initial position. In step 1100 the user slides forward in the chair 10, allowing the back portion 14 to slide forward against his or her back. In step 1200 the user decides whether or not to reposition the back portion 14. If the user decides to reposition the back portion 14, the user will actively release the back portion so that it can move rearward and repeat the method, returning to step 1000. Otherwise, the user will take no further action.

Figure 7:
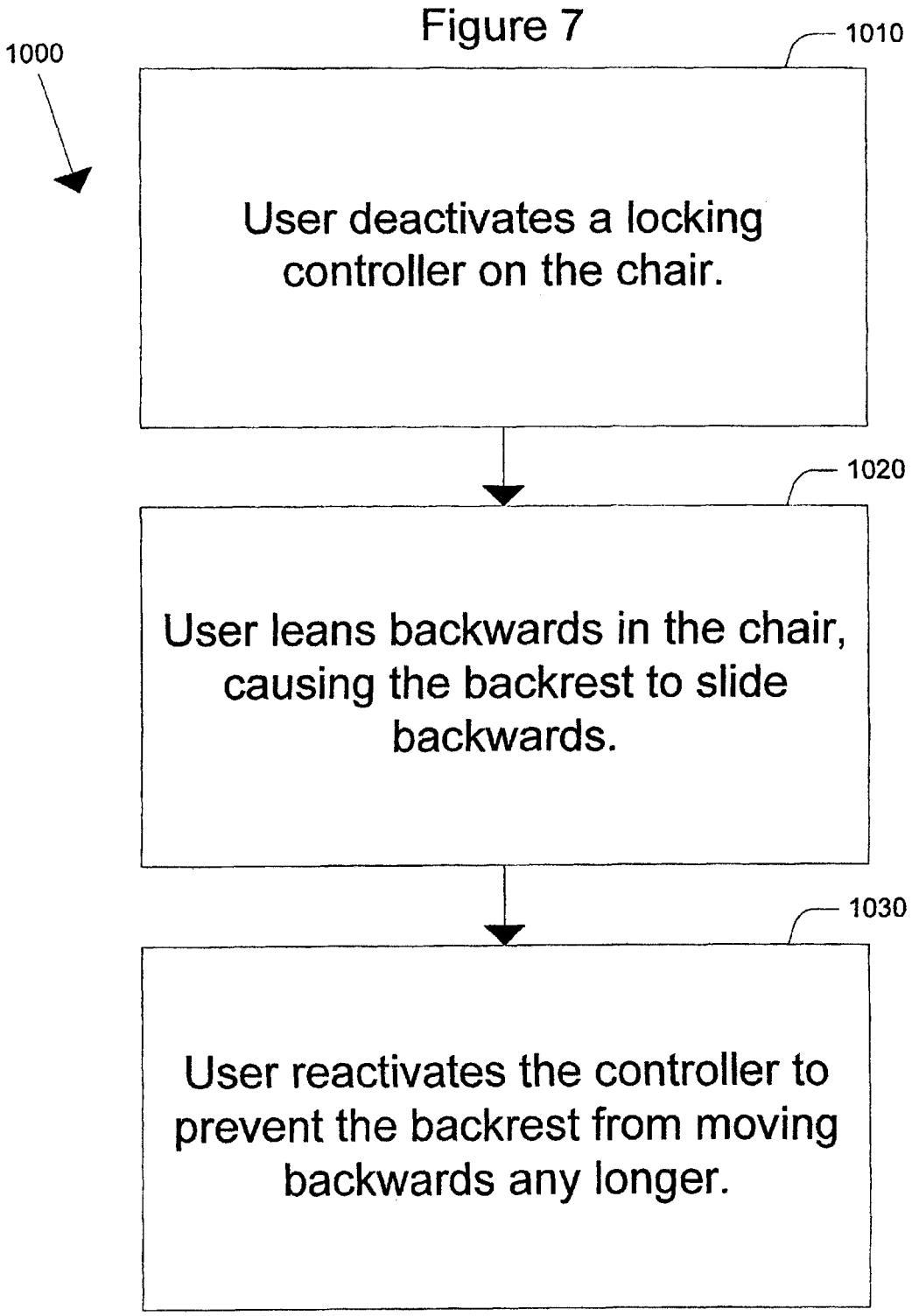
FIG. 7 is a flowchart showing a method of adjusting the backrest of the chair.

FIG. 7 is a flowchart which further illustrates step 1000 of the method illustrated in FIG. 6. In step 1010 the user deactivates a controller 26 on the chair 10. In step 1020 the user leans back in the chair 10, thereby positioning the back portion 14 towards the rear of the chair 10. In step 1030 the user reactivates the controller 26, thereby locking the controller 26 to prevent further motion in a rearward direction 104.

As noted above, embodiments of the invention are directed to chairs 10 having back portions 14 that are forward biased to provide sufficient spinal contact/support to the occupant, even as the occupant slides forward in the chair 10. The occupant may set an initial location for the back portion 14, and as he or she slides forward in the chair 10, the back portion 14 will slide forward together with the occupant's back. This prevents the occupant from losing back support as soon as he or she slides forward in the chair 10, which he or she may do unconsciously out of habit. Therefore, the occupant will not sit for extended periods of time without sufficient spinal contact/support. An embodiment is also directed to a method of operating such a chair.

While this invention has been particularly shown and described with references to preferred embodiments thereof, it will be understood by those skilled in the art that various changes in form and details may be made therein without departing from the spirit and scope of the invention as defined by the appended claims.

For example, the positioner 20 was described, by way of example only, as having a pipe 50, a spring 66, and a pin 54, etc. Instead, a hydraulic system could be utilized for the same purpose. Similarly, an electronic system having actuators and sensors and optionally computer control could be used as well.

As another example, the back portion 14 and armrests 18 were described, by way of example only, as connecting to the controller 26 by means of connecting bars 22, 24. Instead, the back portion 14 and armrests 18 could be directly attached to the controller 26, or they could be attached through some other means, such as by an electromagnetic force.

As another example, the armrest control element 92 and tilt control element 80 were depicted as buttons. However, a pull handle could be used for the same purpose. Similarly, the pull handle 62 of the controller 26 was depicted as an actual handle. It could also be implemented as an electronic button, for example.

As another example, the figures depict an office-style chair which swivels and rolls, but any person having ordinary skill in the art will appreciate that the invention may be applied to any kind of chair, for example a 4-legged stationary chair.

As another example, it should be understood that the chair 10 is capable of providing additional features under control of a handle or lever (e.g., see the handle 30 in FIGS. 1A, 1B, 2, 5A, and 5B). For example, in some arrangements, the chair 10 includes a handle 30 which selectively enables and disables operation of the positioner 20. That is, the user is able to direct the chair 10 to operate in automatic or manual bypass mode based on the position of the handle. Along these lines, if the user wishes to vacate the chair 10 without allowing the back portion 14 to slide forward in his or her absence, the user may pull out the handle to deactivate the automatic features of the chair 10 as described above. Subsequently, when the user returns to the chair 10, he or she may push the handle inwards to reactivate the automatic forward biased feature of the chair 10.

As another example, the chair 10 is capable of further including well-known features, such as height control or tilt control of the seat portion 12. Such features are capable of being controlled by a separate control member such as the handle 30.

The creative practitioner of ordinary skill in the art will appreciate that the embodiments illustrated in FIGS. 1*a*-7 are merely exemplary, and illustrate certain principles of the invention. It should be evident, however, that the invention is broader in conception and is in no way limited to a chair configured as, for example, that of FIG. 1*a*. Accordingly, other features of the invention are illustrated in the further embodiments presented herewith.

As will be understood from the preceding examples, and from those which follow, a device according to the present invention provides back support to a dynamic user. Thus, whereas a conventional support system, such as a chair, may be adjustable to accommodate various user positions, it does not adapt to provide adequate support to a user who has shifted position after the system has been adjusted. In contrast, a support device according to the present invention adjusts dynamically to provide substantial support to the back of a user as the user shifts position.

As will be described below, this novel dynamic adjustment can be utilized in any of a wide variety of devices and systems to dictate a position and orientation of the user's spine so as to provide therapeutic support and stabilization to the curvatures of the spine and to maintain an upright posture. Having reviewed the disclosure provided herewith, the creative practitioner of ordinary skill in the art will readily understand the following exemplary embodiments, and will perceive other systems and devices in which the principles of the invention may be effected.

Figure 8:
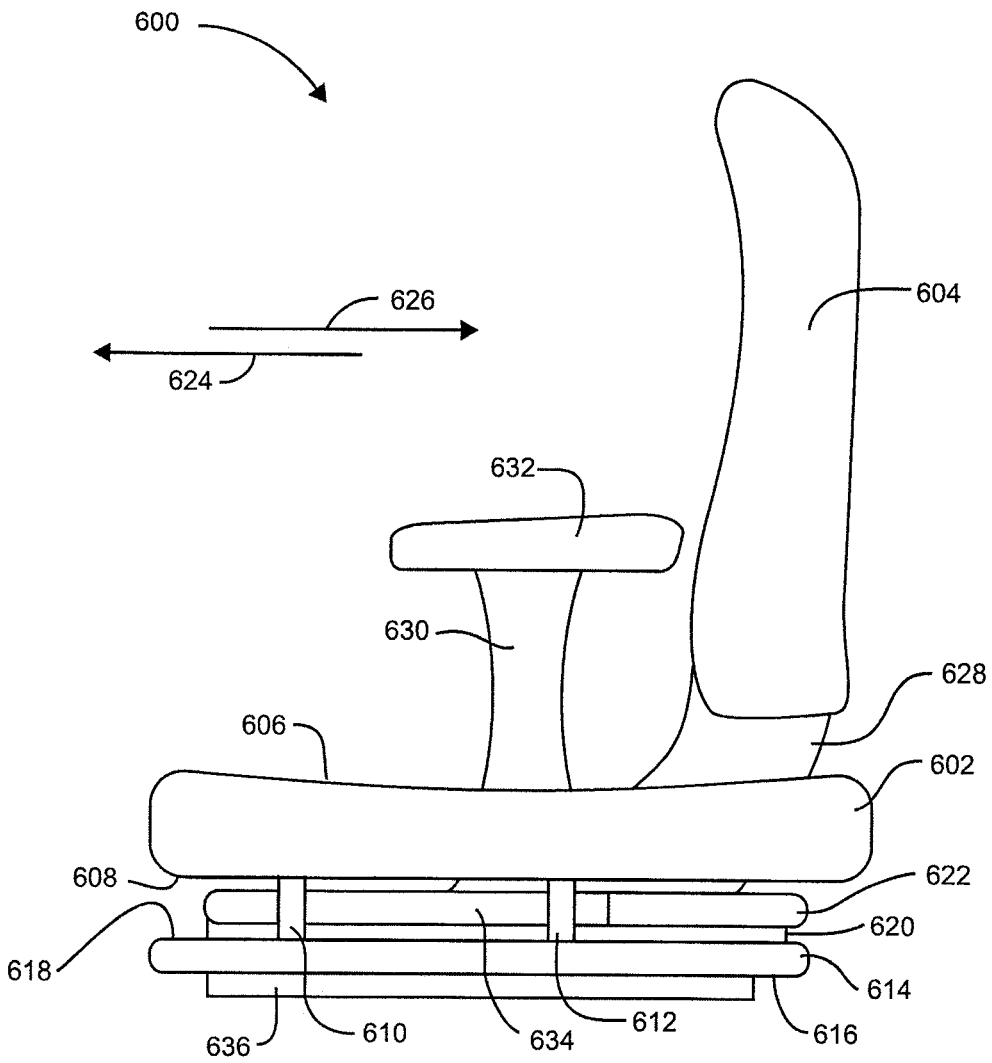
FIG. 8 shows, in cross-section, a portion of a chair including a back support according to principles of the invention.

FIG. 8 shows, in cross-section, a portion of a further exemplary chair including a back support mechanism 600 according to principles of the invention. The chair includes a seat portion 602 and a back support portion 604. The seat portion 602 includes an upper surface 606 and a lower surface 608. In the illustrated embodiment, the seat portion 602 is supported from below by a plurality of stanchions e.g., 610, 612. It will be evident to the creative practitioner of ordinary skill in the art that the function of the stanchions can be served, in respective embodiments, by a wide variety of other support members. Such support members may include more or less rigid support members. In certain embodiments, a support member is a substantially circular cylindrical member, a substantially square cylindrical member, a rectangular member, a substantially frusto-conical member, or any other configuration adapted to provide the requisite coupling.

As shown, the stanchions 610, 612 are coupled between the seat portion 602 and a support plate 614. Consequently, the seat portion 602 and support plate 614 are held in substantially fixed relation to one another. The support plate 614 includes a lower surface 616 and is adapted to be supported from below by, e.g., a caster-equipped base.

The support plate 614 includes an upper surface 618. In the illustrated embodiment, a portion of surface 618 is coupled to a linear bearing 620. The linear bearing 620 is also coupled to a surface region of a translation plate 622. This arrangement allows the translation plate to be translated forwardly 624 and rearwardly 626 with respect to the support plate 614. In one embodiment, as will be further described below, translation plate 622 includes an aperture 634, shown here as a slot, within which the stanchions 610, 612 are disposed. This allows the translation plate 622 to move laterally with respect to support plate 614 without interfering with the stanchions 610, 612.

A first coupling member 628 is substantially fixedly coupled between translation plate 622 and back support portion 604. In one embodiment of the invention, coupling member 628 is substantially rigid and serves to hold back support portion 604 in substantially fixed spaced relation with respect to translation plate 622. In another aspect of the invention, coupling member 628 has some appreciable elasticity such that back support portion 604 is more flexibly mounted to translation plate 622. In either case, the coupling of back support portion 604 through coupling member 628 and translation plate 622 to linear bearing 620 allows a translational motion 624, 626 of back support portion 604 with respect to support plate 614.

In the illustrated embodiment, a second coupling member 630 is substantially fixedly coupled between translation plate 622 and an armrest 632. In one embodiment of the invention, second coupling member 628 is substantially rigid and serves to hold armrest 632 in substantially fixed spaced relation with respect to translation plate 622. In another aspect of the invention, the second coupling member 630 has some appreciable elasticity such that armrest 632 is more flexibly mounted to translation plate 622.

In either case, the coupling of armrest 632 through second coupling member 628 to translation plate 622 allows armrest 632 to translate with respect to the support plate 614 while remaining in substantially fixed spaced relation with respect to back support portion 604. It will be understood by one of skill in the art that first 628 and second 630 coupling members are, in certain embodiments, implemented as a single integrated coupling member, but that a wide variety of arrangements to achieve the specified function would fall within the scope of the present invention.

As shown, a lower surface of the support plate 614 is coupled to a rack 636. The rack 636 serves, in conjunction with further features of the device as described below, to moderate or control a translational movement of the back support portion 604 with respect to the seat portion 602.

Figure 9:
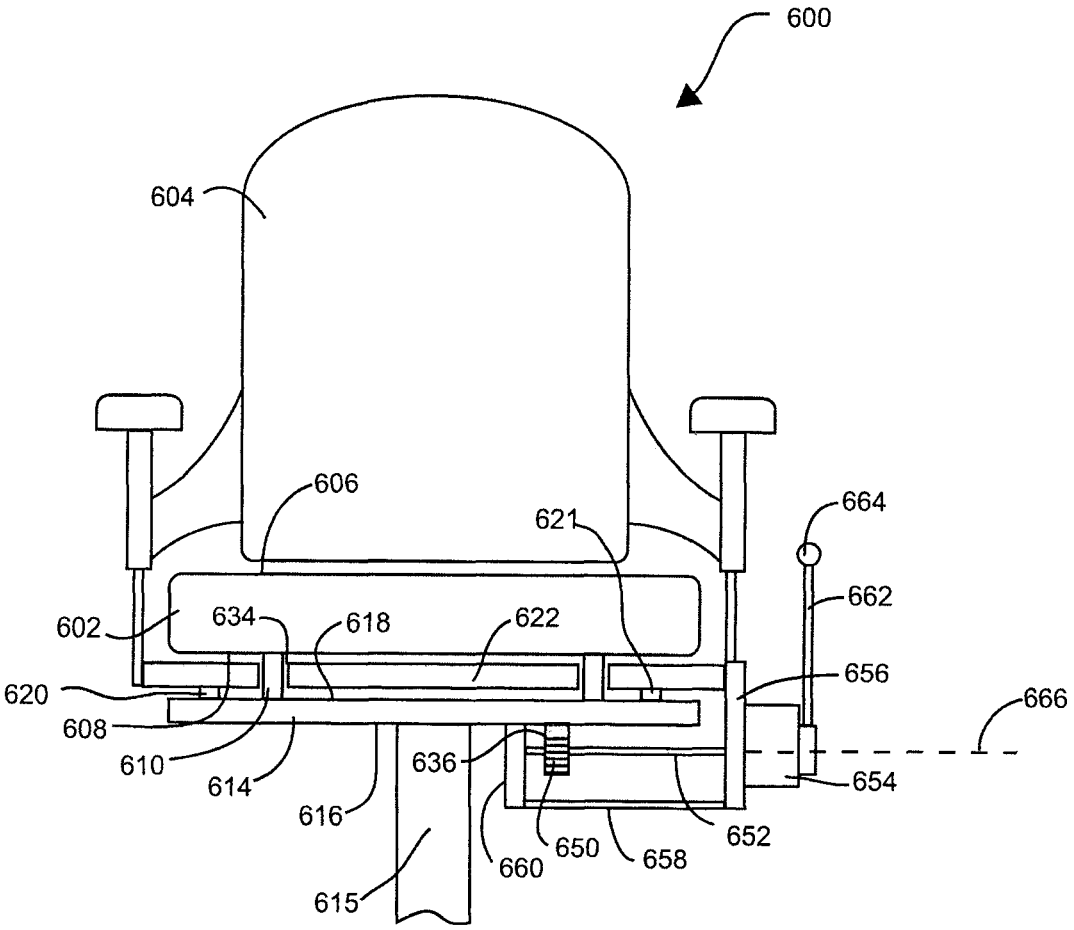
FIG. 9 shows a further portion of a chair including a back support according to principles of the invention.

FIG. 9 shows a front view of a portion of a chair including a back support mechanism 600 as shown in FIG. 8. As previously discussed, the chair includes a seat portion 602 and a back support portion 604. The seat portion 602 includes an upper surface 606 and a lower surface 608. A plurality of stanchions, e.g., 610 are disposed between the seat portion 602 and a support plate 614 so that the seat portion 602 is substantially fixedly coupled to the support plate 614. In the illustrated embodiment, support plate 614 is coupled to a supporting column 615. As will be discussed more fully below, however, any of a wide variety of support devices are coupled to support plate 614 in various embodiments of the invention. Thus, for example, where the chair is employed in a vehicle, support plate 614 may be substantially fixedly coupled to a portion of the vehicle structure.

In the illustrated embodiment, first 620 and second 621 linear bearings are coupled between upper surface 618 of support plate 614 and translation plate 622. As shown, slots 634 within translation plate 622 allow the translation plate 622 to translate with respect to support plate 614 without interfering with the stanchions, e.g. 610.

As described above, the present embodiment includes a rack 636 coupled to lower surface 616 of support plate 614. FIG. 9 shows a pinion gear 650 disposed so as to engage with the rack 636. The pinion gear 650 is coupled to a shaft 652, which is, in turn, coupled to a drive device 654. A plurality of structural members 656, 658, 660 are disposed to couple the drive device 654 substantially rigidly to the translation plate 622. It should be noted that structural member 660 is mechanically independent of support plate 614, and is not connected to lower surface 616.

In the illustrated embodiment, the drive device 654 includes an actuator handle 662 including a grasping portion 664. In operation, the grasping portion 664 is grasped by a user, and the actuator handle 662 is rotated in reciprocating fashion about an axis of rotation 666 to effect a desired translation of the translation plate 622 with respect to support plate 614.

Figure 10:
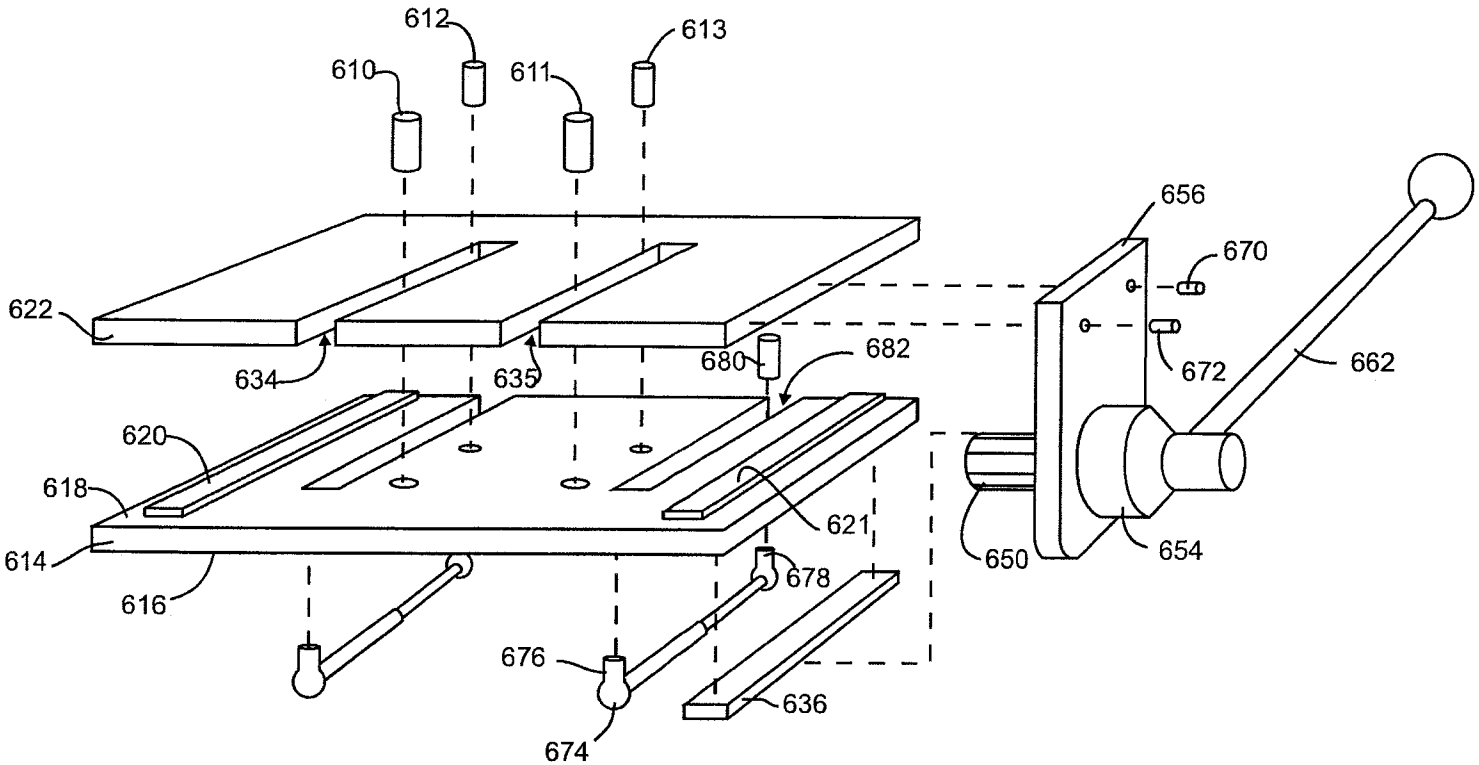
FIG. 10 shows, in exploded assembly view, a portion of a back support device according to principles of the invention.

FIG. 10 shows, in exploded perspective view, a portion of a chair including a back support mechanism 600 as shown in FIGS. 8 and 9. In view of the disclosure of FIGS. 8, 9 and 10, and the corresponding text, the practitioner of ordinary skill in the art will readily understand the arrangement and operation of the illustrated embodiment of the invention. With reference to FIGS. 8 and 9, FIG. 10 shows a support plate 614 a translation plate 622 first 620 and second 621 linear bearings. Stanchions 610, 612, 611 and 613 are adapted to be substantially fixedly coupled to upper support plate 614 at upper surface 618, and to be disposed within apertures 634, 635 of translation plate 622 when translation plate 622 is coupled to linear bearings 620 and 621.

Also illustrated is rack 636, which is adapted to be substantially fixedly coupled to lower surface 616 of support plate 614. Rack 636 is adapted to engage pinion gear 650 which is driven in rotation by operation of the actuator handle 662 of the drive device 654.

As shown, the drive device 654 is supported by structural member 656 which is substantially fixedly coupled to translation plate 622. In the illustrated embodiment, the coupling between structural member 656 and translation plate 622 is effected by use of fasteners 670, 672 such as, for example, machine screws, rivets or bolts, or combinations thereof. Alternative fastening means include the use of chemical adhesives, electronic, gas or ultrasonic welding, or integral formation (as, e.g., by casting) of the translation plate 622 and structural member 656. Thus, one of skill in the art will appreciate that any of a wide variety of methods may be used to provide the requisite support for the drive device 654, and still fall within the scope of the present invention.

According to one embodiment of the invention, as illustrated in FIG. 10, one or more gas spring devices 674 are provided. As shown, gas spring device 674 is coupled at a first end 676 to support plate 614, and at a second end 678 to an extension device 680. The extension device 680 is disposed within an aperture 682, such as a slot, in the support plate 614, and is substantially fixedly coupled to translation plate 622 at a lower surface thereof. In one embodiment, the gas spring device 674 is adapted to urge translation of the translation plate 622 forwardly with respect to support plate 614. Of course, one of skill in the art will appreciate that any number of alternative devices could be used in place of the illustrated gas spring, with similar effect.

A method of operation according to principles of the invention will be described with respect to the chair and back support mechanism 600 of FIGS. 8-10. It should be understood, however, that the details of the described method exemplify the method, and are not intended to limit the scope of the invention. As noted above, a support device according to the present invention is adapted to provide support to the back of a user (i.e., a rear surface of a user's torso) notwithstanding motion of the user with respect to for example a seat portion, during normal activities.

According to one embodiment, the method includes moving a back support portion of a chair forward to maintain engagement with a user's back when the user moves forward with respect to a seat portion, and resisting rearward motion until a release signal is received thus maintaining an optimal position and orientation of the user's spine, and providing therapeutic support and stabilization to the curvatures of the spine and maintaining an upright posture. When a user moves from a rearward position on the seat to a more forward position on the seat, the back support portion moves to follow the user and remain substantially in contact with users back.

Thereafter, the back portion is adapted to provide support to the users back, and not merely deflect elastically, rotate or otherwise move out of the way as a user leans back. Rather, the back support portion provides therapeutic support and stabilization to the back of the user in the new destination position. This maintains the spine in a desirable upright orientation with an advantageous curvature.

Thereafter, in accordance with a signal provided consciously or unconsciously by the user, the back support portion may be reset to a more posterior location including, but not limited to, an original location. In its new location, the back support portion again provides therapeutic support to the users back. In various embodiments, an infinite adjustability is available so that the back of the user is properly and continuously supported in an upright position by the back support portion regardless of where the user is located at any particular time, and regardless of ongoing motions of the user.

The previously described devices illustrate various apparatus for achieving the desired result. Referring now to FIGS. 8-10, a user sitting on the upper surface 606 of the seat portion 602 of the chair of FIG. 9 grasps grasping portion 664 of handle 662 and reciprocates the handle in an angular motion about axis 666. Responsively, pinion gear 650 rotates and drives rack 636 forwardly with respect to the drive mechanism 654. It will be clear to one of ordinary skill in the art that alternative mechanisms within the scope of the invention will be activated by alternative user actions.

In the illustrated embodiment, the drive mechanism is provided with a ratchet device including, for example, a ratchet and pawl, adapted to allow the pinion gear to move during one portion of the handle cycle and to hold the drive mechanism in place during a second portion of the cycle. Accordingly, oscillation of the handle causes the pinion gear to jack along the rack. This motion proceeds against the urging of gas spring 674.

Because the drive mechanism 654 is coupled through support member 656 to the translation plate 622, the translation plate 622 moves rearwardly with respect to the support plate 614. Because of the previously described structural relationships, the back support portion 604 also moves rearwardly with respect to the seat portion 602.

When the back support portion 604 reaches a desired location with respect to the seat portion 602, the user positions him or herself with his or her back adjacent to the front surface of the back support portion 604. Thereafter, a release action is taken with respect to the drive mechanism 654. According to one embodiment of the invention, this release action includes rotating the handle 662 to a particular position (e.g., an extreme forward position or an extreme rearward position). The release action causes the pinion gear 650 to be released (i.e., freewheel in one direction) so that the back support portion 604 is urged forward against the back of the user by the action of the gas spring 674, for example.

According to one embodiment of the invention, the drive mechanism 654 is arranged so that after the release action is taken, the pinion gear 650 turns freely only in one direction. Thus, if the user leans back against the back support portion 604 after the release action has been taken, the engagement of pinion gear 650 with the rack 636 will serve to resist backward motion of the back support portion 604, and the back support portion 604 will tend to support the user. That is, the user can lean back against the back support portion 604, and the back support portion will not retreat freely or elastically. Nor will it rotate into a new orientation. Rather, it will oppose the backward force applied by the user, and tend to support the user in a desirable and surprisingly beneficial fashion. In various embodiments a surface of a back support portion is contoured to match a back of a user and help provide therapeutic support and stabilization when it is in contact with a user's back.

If, on the other hand, the user moves forward with respect to the seat portion 602, back support portion 604 tends to move forward correspondingly, under the urging of the gas spring 674. As noted above, the pinion gear 650 is allowed to freewheel during this motion, such that the motion is not resisted by the drive mechanism 654. Consequently, the back support portion 604 tends to proceed forwardly, maintaining, or quickly recovering, contact with the back of the user. It should be noted that, in various embodiments, the gas spring 674 device includes a damping characteristic such that arrival of the back support portion 604 in contact with the back of the user occurs gently, and without any undesirable impulse or shock.

Once the user has stopped moving forward, and equilibrium of forces with the back of the user is resumed, the motion of the back support portion 604 is again arrested. If the user then leans backward, the previously described stopping action of the pinion gear again combines with the illustrated structure to hold the back support portion 604 in place and provide support to the users back.

According to the illustrated embodiment, if the user wishes to resume a more rearwardly position on the seat portion 602 he or she again actuates the handle 662 to move the back support portion backward as previously described. It should be understood, however, that operation of the handle 662, and indeed the entire mechanical arrangement described to include drive mechanism 654 rack 636 and pinion 650 is merely illustrative of one embodiment by which the invention can be practiced. One of skill in the art will appreciate that a wide variety of mechanical arrangements, more or less active, and more or less automated, can provide beneficial operation of the invention such that the back of the user is therapeutically supported and maintained in an upright position even as the user changes position over time.

One skilled in the art will appreciate that appropriate materials are used with respect to particular components of a back support device according to principles of the invention. Exemplary metallic materials adaptable for use in the present invention may include stainless steel; aluminum; an alloy such as Ni/Ti alloy; any amorphous metals including those available from Liquid Metal, Inc. or similar ones, such as those described in U.S. Pat. No. 6,682,611, and U.S. Patent Application No. 2004/0121283, the entire contents of which are incorporated herein by reference.

In like fashion, certain portions of embodiments of the present invention are made of appropriate polymer materials. Suitable polymers include polyethylene, polypropylene, polybutylene, polystyrene, polyester, acrylic polymers, polyvinylchloride, polyamide, or polyetherimide like ULTEM®; a polymeric alloy such as Xenoy® resin, which is a composite of polycarbonate and polybutyleneterephthalate or Lexan® plastic, which is a copolymer of polycarbonate and isophthalate terephthalate resorcinol resin (all available from GE Plastics), liquid crystal polymers, such as an aromatic polyester or an aromatic polyester amide containing, as a constituent, at least one compound selected from the group consisting of an aromatic hydroxycarboxylic acid (such as hydroxybenzoate (rigid monomer), hydroxynaphthoate (flexible monomer), an aromatic hydroxyamine and an aromatic diamine, (exemplified in U.S. Pat. Nos. 6,242,063, 6,274,242, 6,643,552 and 6,797,198, the contents of which are incorporated herein by reference), polyesterimide anhydrides with terminal anhydride group or lateral anhydrides (exemplified in U.S. Pat. No. 6,730,377, the content of which is incorporated herein by reference) or combinations thereof. In addition, any polymeric composite such as engineering prepregs or composites, which are polymers filled with pigments, carbon particles, silica, glass fibers, conductive particles such as metal particles or conductive polymers, or mixtures thereof may also be used. For example, a blend of polycarbonate and ABS (Acrylonitrile Butadiene Styrene) may be used.

It should also be understood that the benefits of the invention are not limited to use in office chairs, or even to seating devices generally, but are realized in a wide variety of situations and applications. Thus, for example, dynamic back support according to principles of the invention is well adapted for use in the passenger seat and driver or pilot seat in a wide variety of vehicles. Such vehicles include personal use vehicles and common carrier vehicles such as buses, trains, ships and airplanes, among others. In addition, the occupants of specialized vehicles such as spacecraft, military vehicles (including tanks and armored personnel carriers), farming and construction equipment, racing vehicles such as racing cars and motorcycles, sports vehicles such as snowmobiles, and a wide variety of other vehicles, can avoid fatigue and otherwise benefit from maintaining a correct upright spinal position by application of support devices prepared according to principles of the present invention.

Nor are the applications limited to vehicles. For example, specialized equipment such as exercise equipment or manufacturing equipment can benefit from the application of user support technology as described herewith. Other applications include stadium seating and game (e.g. video game) consoles, for example. With this in mind, a variety of other exemplary embodiments are now described. It should be borne in mind, however, that these descriptions are purely illustrative, and are in no way intended to be limiting.

Figure 11:
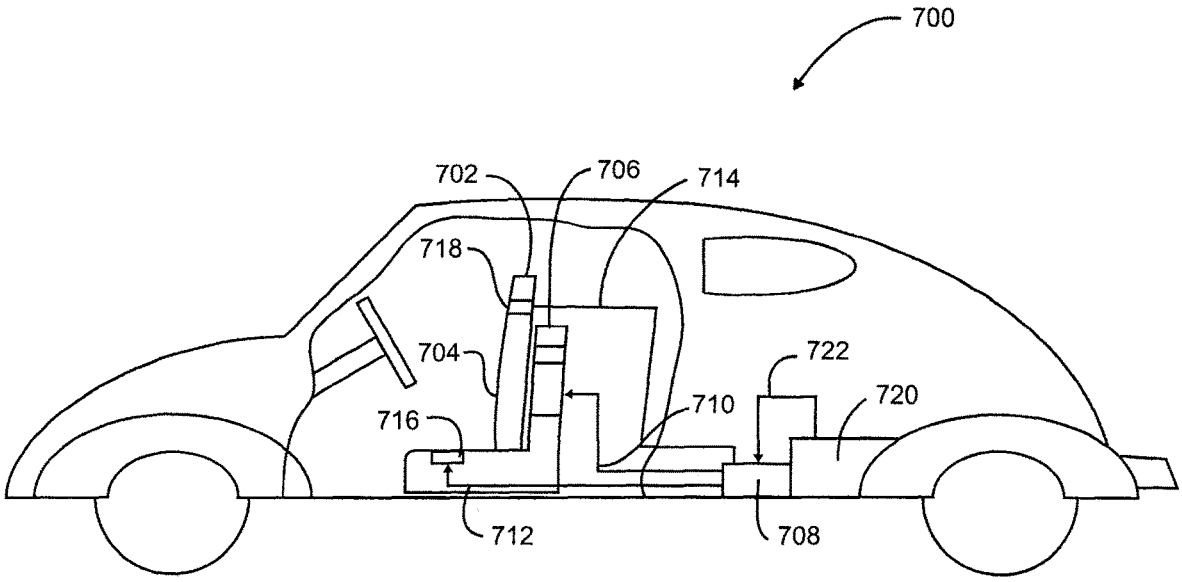
FIG. 11 shows, in schematic cutaway cross-section, a portion of an exemplary vehicle including a back support device according to principles of the invention.

FIG. 11 shows a vehicle 700 (here a passenger car) including a back support device according to the present invention. The back support device 702 includes a forward surface 704 adapted to be disposed adjacent to, and in contact with, a back of the user. According to one embodiment, as illustrated here, motion of the back support device 702 is actively controlled. For example, computer control of an electric or other motor can be used to ensure that a support surface of the back support device remains substantially in contact with a user's back. Consequently the user's back is supported regardless of a motion of the user with respect to a seat portion.

In one embodiment, the position of the back support device 702 is adjusted by the application of forces by an active device. In various embodiments, the active device may include one or more of a rotary electromagnetic motor, a linear electomagnetic motor, a solenoid, a pneumatic device, a hydraulic device, a piezoelectric device and a thermoexpansive device, among others.

In the embodiment shown, the active device 706 is disposed, for example, behind the back support device 702. A processor device 708 including, for example, one or more of a microprocessor, a microcontroller, hardwired processor, or any other appropriate general-purpose or specialized processor device is provided. The processor device is signalingly coupled 710 to control an operation of the active device 706. One of skill in the art will appreciate that such control can be achieved by, e.g., the use of amplifiers and servomotors or stepper motors.

The processor device 708 is also signalingly coupled 712, 714 to receive a signal from one or more sensors, e.g. 716, 718. One of skill in the art will appreciate that useful sensors will include, in certain embodiments, one or more of a weight sensor 716 adapted to sense a weight of a user, a force sensor adapted to sense a rearward force applied by the user and a position sensor adapted to detect a position of the user's back with respect to the support device 702. A power source 720 (e.g., a battery or generator) within the vehicle may be coupled 722 to the processor device to provide power for activation of the active device 706.

Figure 12:
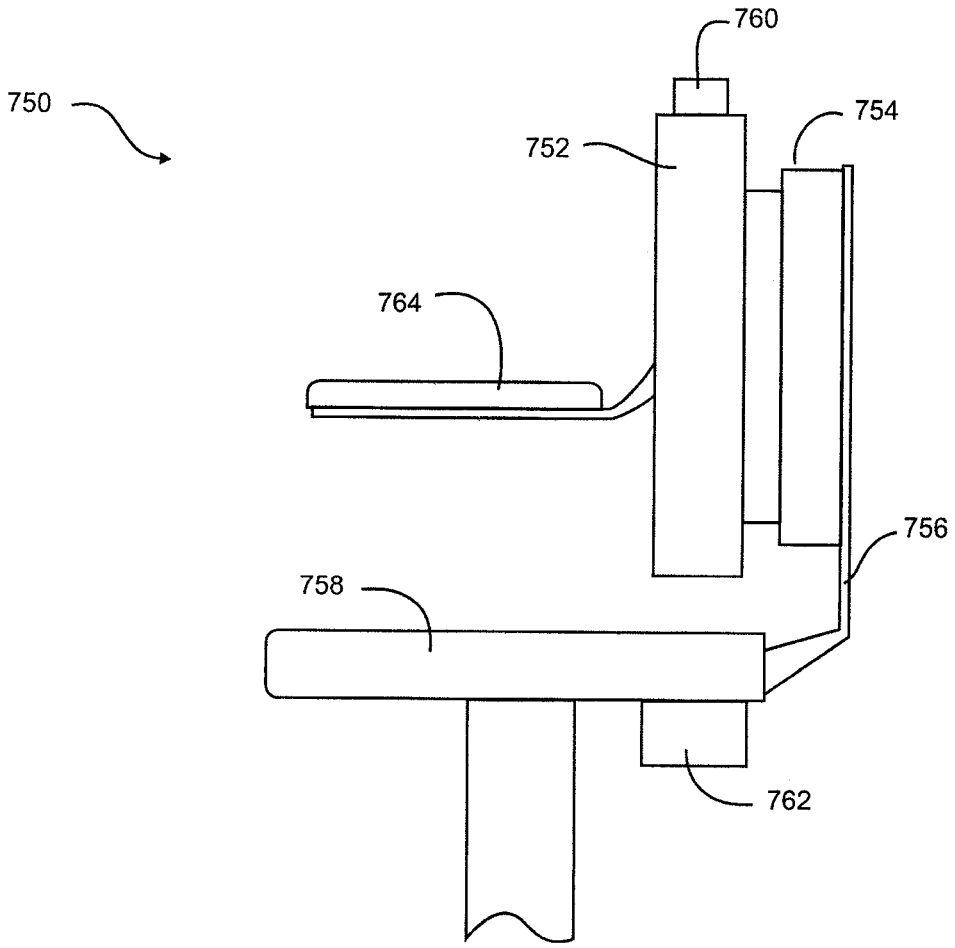
FIG. 12 shows further aspects of a back support device according to principles of the invention.

FIG. 12 shows a further embodiment of a seat 750 including a back support portion 752. In the illustrated embodiment, the back support portion is coupled to an active device disposed within, for example, a telescopic enclosure 754. A rear surface of the telescopic enclosure is coupled to a substantially rigid support member 756, so that the rear surface of the telescopic enclosure is maintained in substantially fixed spatial relation to a seat portion 758.

A sensor 760 provides information to a controller 762. The controller controls the active device to maintain the back portion firmly in contact with a back of a dynamically moving user according to principles of the invention, as described above. In the illustrated embodiment, an armrest portion 764 is substantially rigidly coupled to the back support portion. Accordingly positional adjustment of the back support portion 752 by the controller 762 and the active device also serves to desirably adjust a position of the armrest portion 764.

Figure 13:
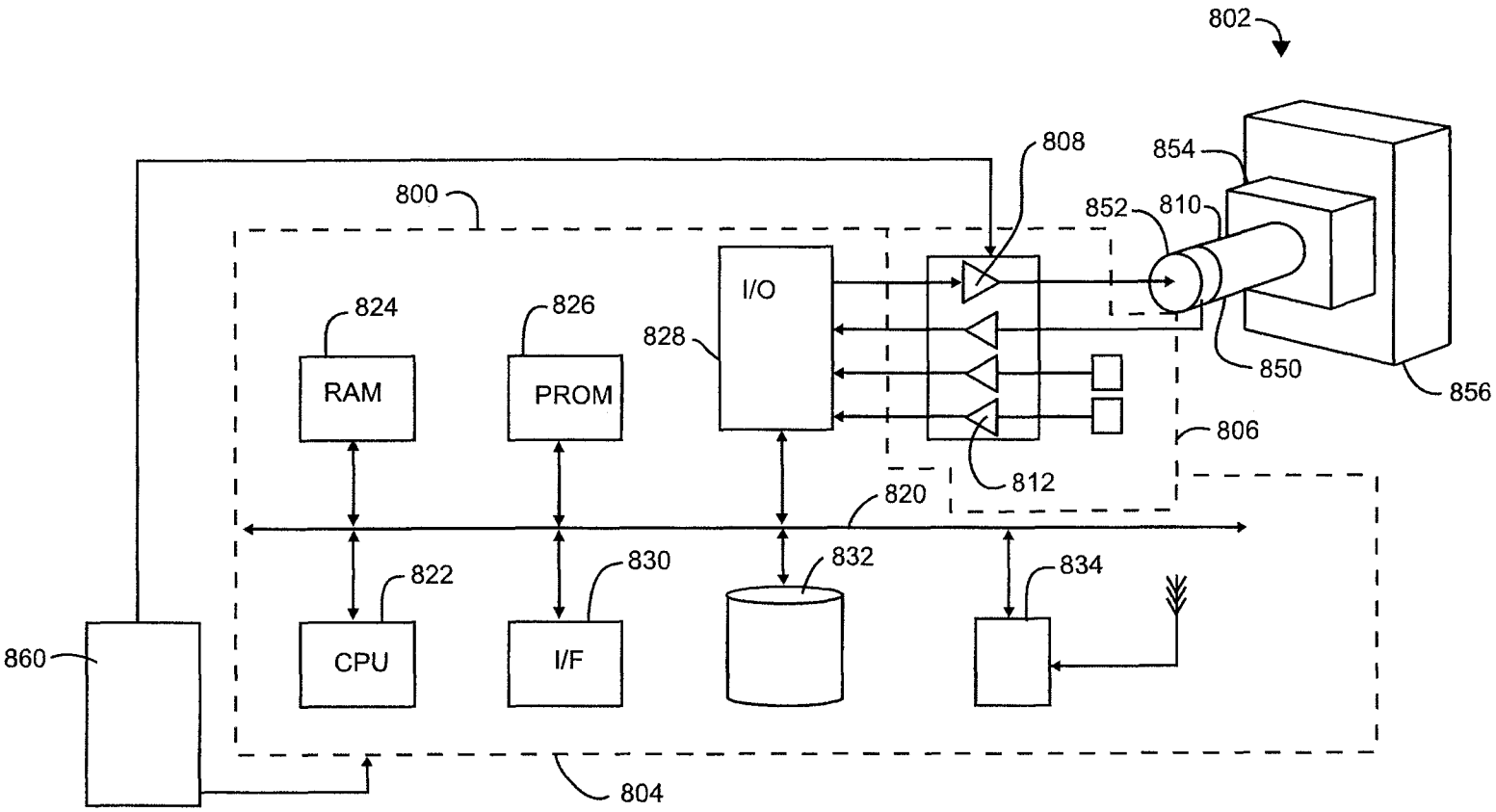
FIG. 13 shows further aspects of a back support device according to principles of the invention.

FIG. 13 shows, in schematic form, a portion of a controller 800 and active device 802 according to one embodiment of the invention. The controller and active device are adapted to dynamically adjust a position of a back support according to principles of the invention, as previously described.

In the illustrated embodiment, the controller 800 includes a processor portion 804 and an I/O portion 806. The I/O portion includes I/O devices such as, for example, a power amplifier 808 adapted to drive a prime mover 810, such as an electric stepper motor or an electric servo motor, and a signal conditioning amplifier 812 adapted to receive and condition a signal from a sensor device.

In the illustrated embodiment, the processor portion 804 includes, for example, a special purpose processor or a general purpose processor. The processor includes various components, according to the requirements of a particular embodiment and application. Thus, in the illustrated embodiment, the processor includes a communications and control bus 820 and a central processing unit 822.

As would be understood by one of ordinary skill in the art, the central processing unit includes any appropriate control device such as, for example, a microprocessor, microcontroller or a hardwired logic controller. In addition, the illustrated processor portion includes a random access memory (RAM) device 824, a read only memory device 826 (such as a masked PROM or an EEPROM, for example), and an I/O device 828 adapted to be signalingly coupled to the I/O portion 806. In addition, the processor portion 804 may include a user interface device 830, a further non-volatile storage device such as, e.g., a hard disk drive 832 and a communications device 834 such as, e.g., a Bluetooth or WiFi communication device.

In operation, a memory device of the system can be configured to a physical state representing a particular software program. As is well-known in the art, instructions of the software program are transferred to the processor device to guide operations of the system as a whole. In certain embodiments of the invention, the processor device receives sensor information and produces outputs to configures mechanical and electro-mechanical portions of the system to apply forces of desirable magnitude, direction, timing and duration.

As illustrated, the active device 802 may include a motor 850 such as a rotary motor or a linear motor, a sensor portion 852 such as an optical encoder or a resolver, for example, and a reducer 854 including, for example, one or more of a worm gear, a planetary gear and a harmonic drive device. Of course in some circumstances, no reduction may necessary.

In addition, a mechanical apparatus 856 is provided to convert an output of the reducer 854 into a desirable motion of a back support portion. In certain embodiments a portable power supply 860, such as, for example, an electrochemical battery is provided to supply power for the controller 800.

Figure 14:
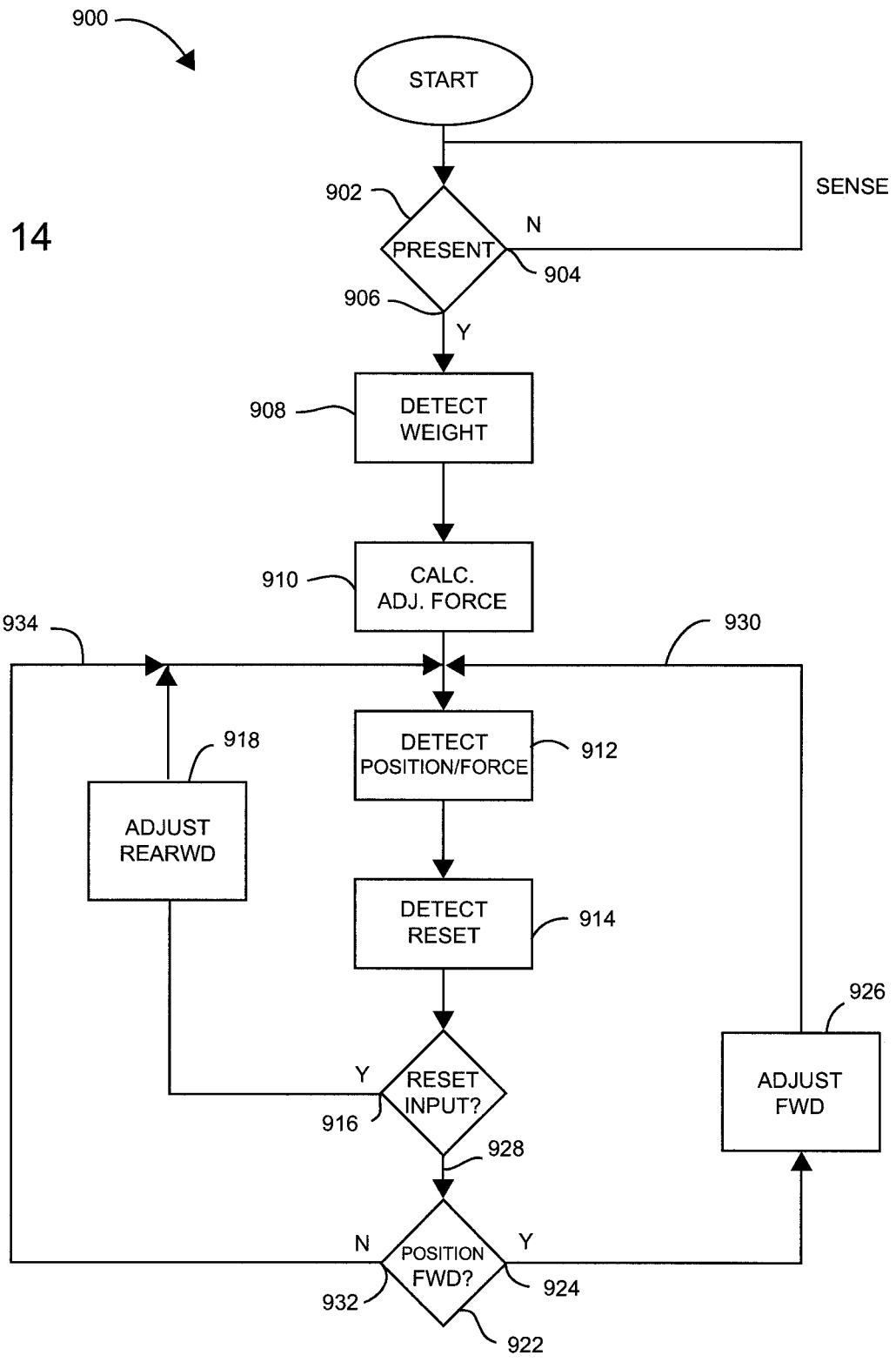
FIG. 14 shows, in flowchart form, further aspects of a back support device according to principles of the invention.

FIG. 14 illustrates a method of operation 900 of a controller to control a support device according to one embodiment of the invention. In a first active step, the controller is adapted to detect 902 a present or absence of a user support device. If no user is detected 904, sensing is repeated without further action.

If a user is detected to be present 906, a further sensor is read 908 to detect a weight of the user. Based on a detected user weight, requisite adjustment forces are determined 910. One of skill and art will appreciate that this determination can be made by real-time calculation, by reference to a lookup table, by analogy, and/or by any appropriate combination of the foregoing methods.

In a further method step, according to one embodiment of the invention a position of and/or force applied by the user with respect to a back support feature is detected 912. In addition, any manual reset input 914 is detected. The received signals are analyzed and appropriate action is taken. Thus, if a reset input is detected 916, the back support portion is adjusted rearward 918 partially, or fully, to a rear stop position.

If no reset condition is detected 928 sensor signals corresponding to a position of the user is evaluated 922. If the user has moved forward 924, then the back support portion is adjusted forwardly 926 and detection is resumed 930. If it is determined that the user has not moved forward 932, detection is simply resumed 934. Of course, in certain embodiments of the invention, a particular (and possibly customized) level of rearward pressure by a user may be used as a reset signal such that, when the signal is detected, the system produces a rearward motion of the back support portion.

Figure 18:
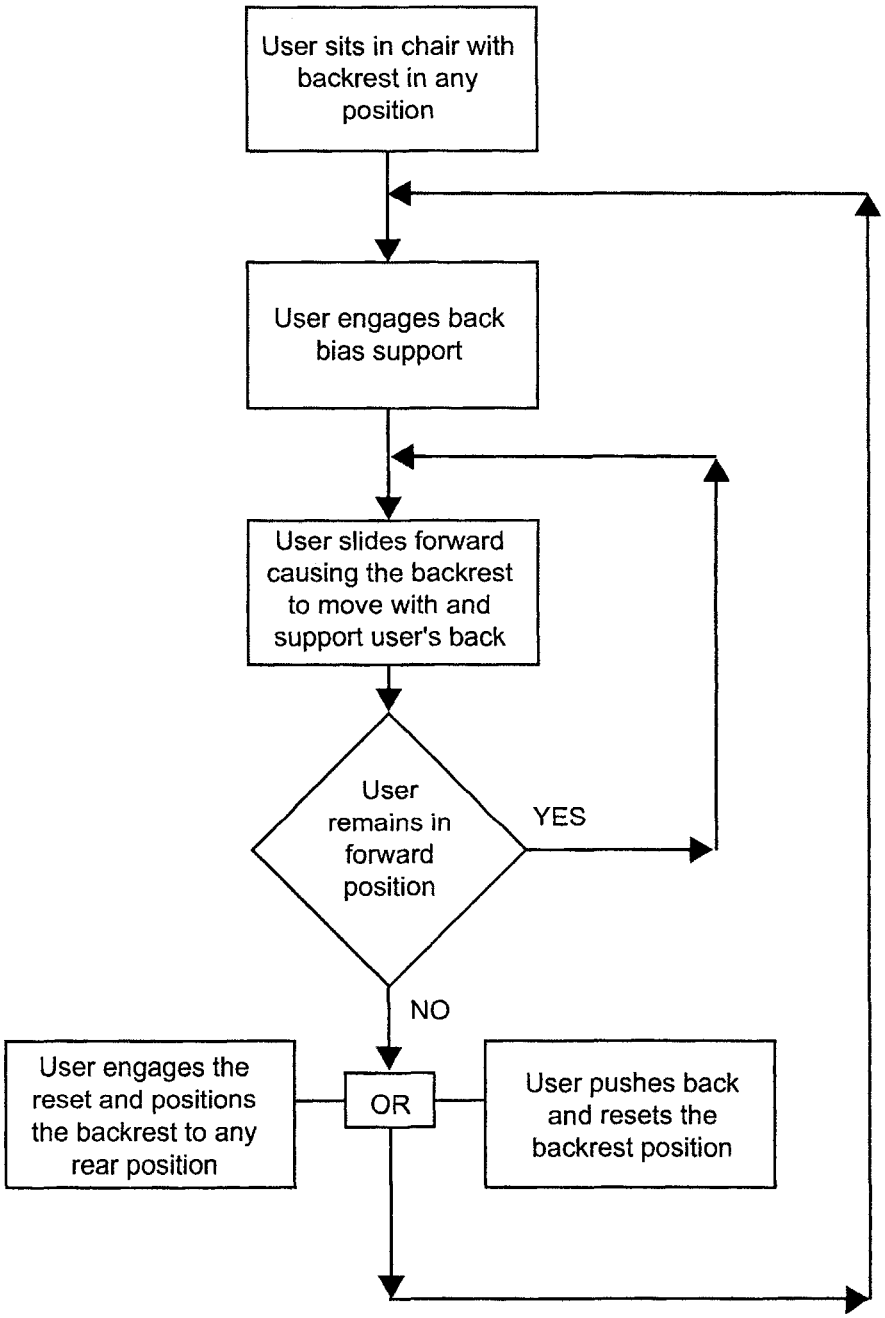
FIG. 18 shows, in flowchart form, further aspects of a back support device according to principles of the invention.
Figure 19:
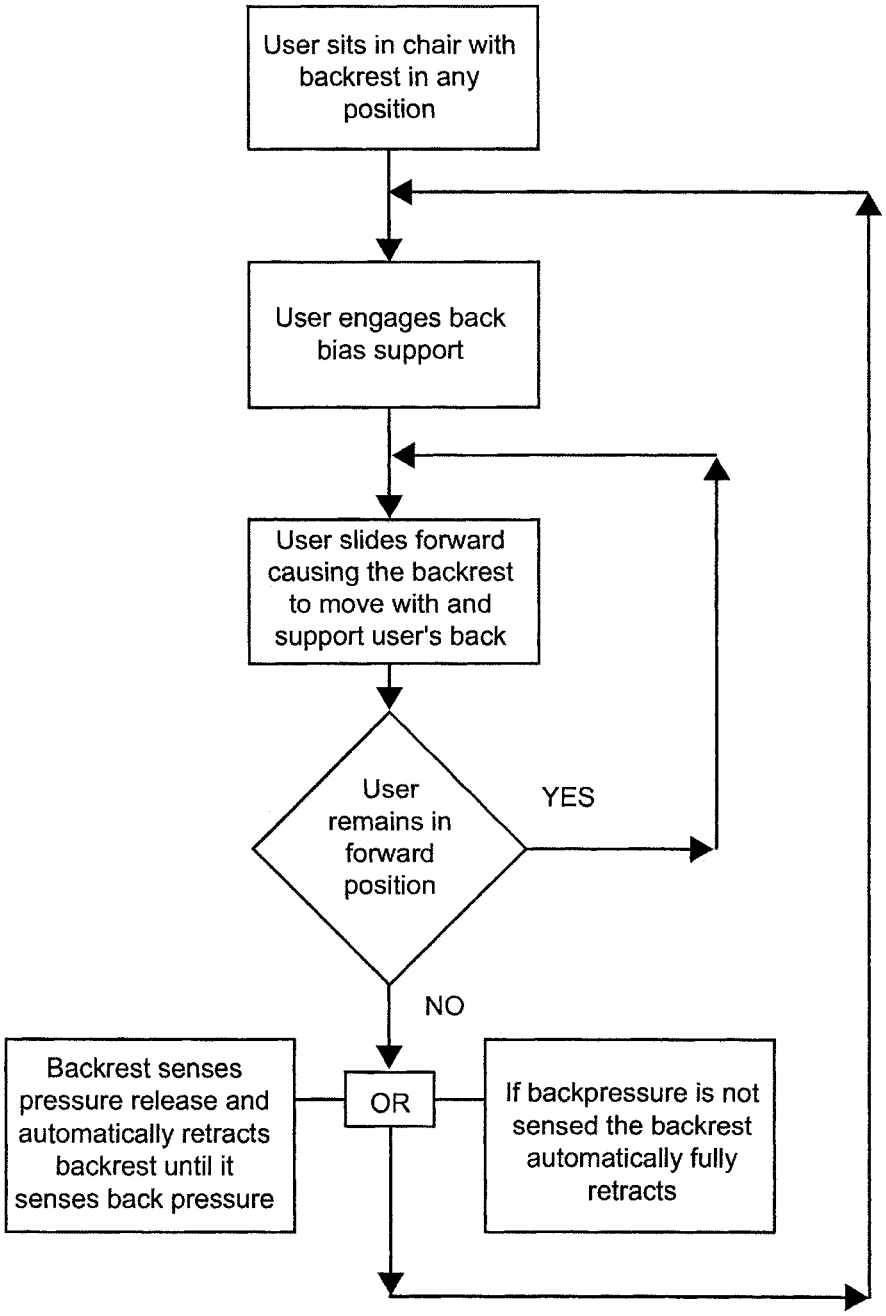
FIG. 19 shows, in flowchart form, further aspects of a back support device according to principles of the invention.

In light of the foregoing discussion it will be clear to one of skill in the art that the back support device prepared according to principles of the present invention is useful in a wide variety of applications and circumstances, and not merely in the context of office furniture. It should also be understood that a variety of apparatus' can be used in different embodiments of the invention to achieve the desired functionality. Thus for example the apparatus of FIG. 1*a* includes a linear bearing including a tubular support and the apparatus of FIG. 8 shows a different linear bearing mounted between a support plate and a translation plate. Other methods embodying the invention are clearly detailed in the flowcharts presented in FIGS. 18 and 19.

FIGS. 15-17A illustrate a further embodiment of a back support device 950 prepared according to principles of the invention. The illustrated device includes a back support portion 952 having a pantographic bearing device 954. The pantographic bearing device 954 includes first 956 and second 958 longitudinal support members. The first longitudinal member is pivotally coupled through a first pivot member 960 to a lower support member 962, and through a second pivot member 964 to an upper support member 966 (visible in FIG. 16). The second longitudinal member is pivotally coupled through a third pivot member 968 to the lower support member 962, and through a fourth pivot member 970 to the upper support member 966.

Figure 15:
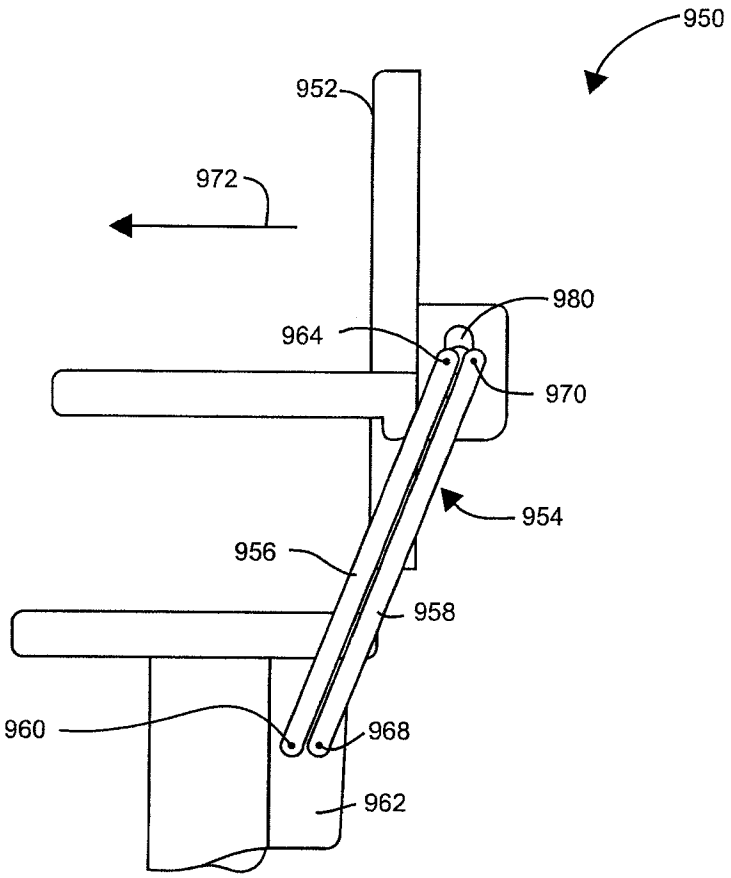
FIG. 15 shows further aspects of a back support device according to principles of the invention.
Figure 17A:
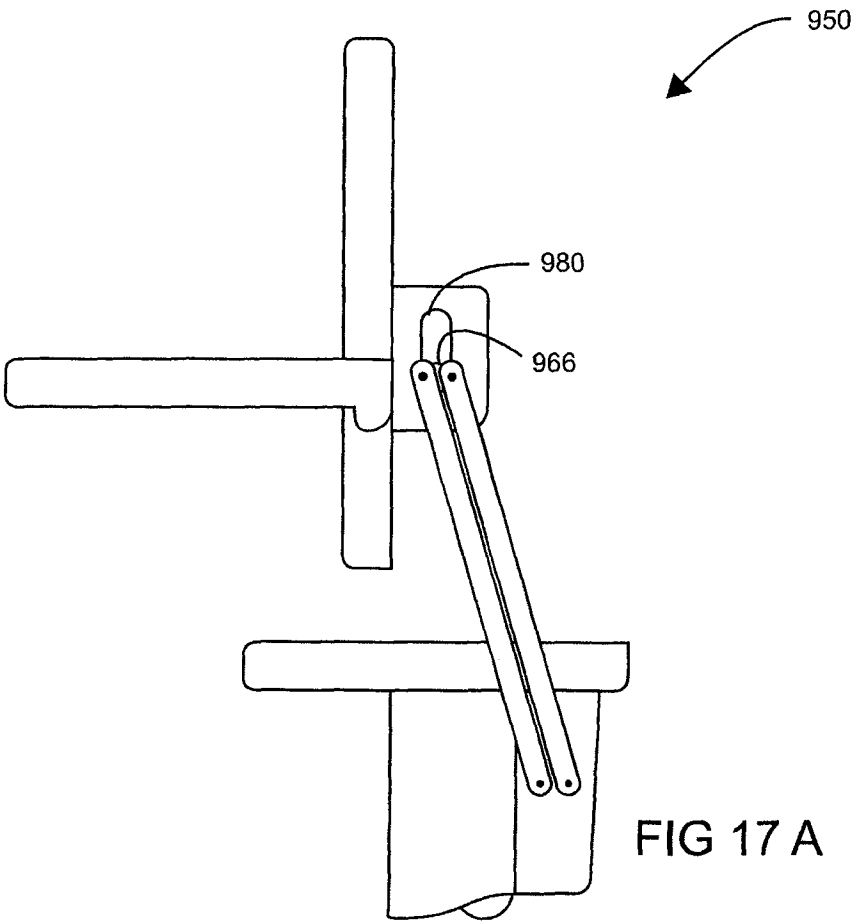
FIG. 17A shows further aspects of a back support device according to principles of the invention.

The longitudinal members 956, 958 are arranged so that the distance between pivot member 960 and pivot member 964 is substantially the same as the distance between pivot members 968 and 970. In addition, the longitudinal members 956, 958 are substantially rigid. Consequently, as the back support portion 952 is advanced forwardly 972 from a first position, as shown in FIG. 15, to a second position, as shown in FIG. 17A, a first line segment defined between pivot members 960 and 968 remains substantially parallel to a second line segment defined between pivot members 964 and 970. This pantographic effect will be familiar to one of ordinary skill in the art, who will recognize that it is nevertheless novel in the present application.

Figure 16:
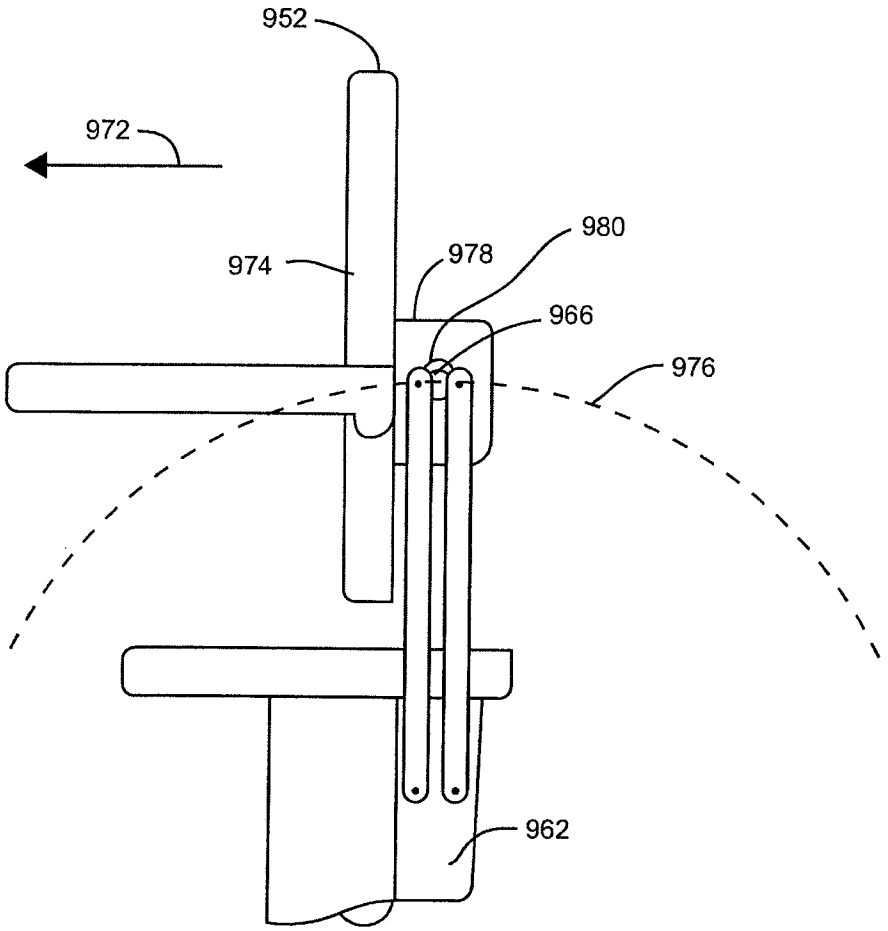
FIG. 16 shows further aspects of a back support device according to principles of the invention.

Referring now to FIG. 16, the pantographic action noted above serves to maintain upper support member 966 in a substantially constant orientation with respect to the lower support member 962. Consequently, by providing an appropriate mechanical coupling between upper support member 966 and the balance of the back support portion 952 a desirable fixed or adjustable orientation of a forward surface region 974 can be maintained. For example, the surface region 974 can be maintained in a substantially vertical orientation as the seatback portion 952 is advanced forwardly 972, rather than changing orientation.

It will be clear on inspection that a point on the upper support member 966 tends to describe an arc 976 as surface region 974 is advanced forwardly 972. Accordingly, in one embodiment of the invention, a device 978 is provided to automatically adjust a position of the upper support member 966 with respect to the balance of the back support portion 952 as the back support portion is moved forwardly. The mechanism of the device 978 is arranged so that, in one desirable embodiment, the seatback portion maintains a substantially constant elevation during a motion of the upper support member 966 along arc 976.

This effect can be seen by considering FIG. 15, in which upper support member 966 is relatively low in a slot 980, and comparing this with the location of upper support member 966 in FIG. 16, which shows the upper support member 966 relatively high in slot 980. A further comparison can be made to the arrangement status of the equipment shown in FIG. 17A in which the upper support member 966 is once again dispose relatively low in slot 980.

In various embodiments, a drive mechanism is provided within lower support member 962. The drive mechanism is adapted to rotate pivot members 960 and 968, or otherwise adjust the orientation of longitudinal members 956 and 958, so as to maintain surface region 974 in proximity to a back of a user for support, as previously discussed.

Figure 17B:
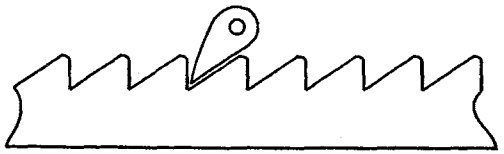
FIG. 17B shows a unidirectional motion device according to certain aspects of the invention.
Figure 17C:
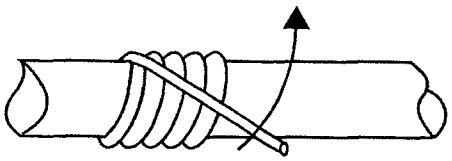
FIG. 17C shows a unidirectional motion device according to further aspects of the invention.

FIG. 17 B shows a unidirectional motion device according to certain aspects of the invention. The exemplary illustrated device includes a linear ratchet having a sawtooth surface configuration and a pawl device.

FIG. 17 C shows a unidirectional motion device according to further aspects of the invention. The exemplary illustrated device includes a bearing member having an external surface adapted to frictionally interact with a gripping device. The illustrated gripping device includes a coil spring portion having an internal frictional surface region. The coil spring portion adapted to receive a release signal which tends to uncoil the coil spring portion, and thus loosen the internal frictional surface region.

Other mechanisms well adapted for use in providing back support to user according to principles of the invention include, for example, a linear actuator driven by a rotating lead screw or an advancing v-belt or timing belt, a pneumatic piston and cylinder arrangement, a hydraulic piston and cylinder arrangement, a linear stepper motor, a solenoid and a scissors jack mechanism actuated by any of the above. These mechanisms, and others as known in the art, can be used alone or in combination according to the requirements of a particular application. In addition, one of skill in the art will appreciate that these mechanisms may be enclosed within a telescoping enclosure (as shown, e.g., in FIG. 12) or within a partially or fully flexible accordion enclosure (such as, e.g., an elastomeric bellows enclosure), as known in the art.

According to a further embodiment of the invention, a substantially rigid back support structure is adapted to be coupled to one or more inflatable bladders. The one or more inflatable bladders are disposed between the substantially rigid back support structure and a back of a user. During operation of the inventive device, a working fluid is injected into or withdrawn from within the inflatable bladder so as to cause a back supporting surface of the back support device to advance or retreat.

In various embodiments, the working fluid is a liquid. In other embodiments, the working fluid is a gas. In certain embodiments, an open cell foam material is disposed within one or more inflatable bladders, and the working fluid is received within pores of the foam material. In certain embodiments, plural inflatable bladders are provided of various sizes. In other embodiments, inflatable bladders of uniform size are employed. According to certain embodiments, bladders of certain sizes and/or locations and/or configurations are operatively coupled so as to facilitate individual and/or group activation.

In certain embodiments, an externally powered pump is provided for control of the working fluid. Other embodiments include a manually actuated pump. Cylinder pumps, centrifugal pumps, peristaltic pumps and bellows pumps are exemplary of the many possible devices appropriate for use in particular applications.

In some embodiments of the invention, a rechargeable power source is provided to motivate a working fluid pump. In other embodiments of the invention, a compressed gas is available to activate the inflatable bladder. According to various embodiments, the compressed gas is stored under high pressure in, for example, a high pressure cylinder. In other embodiments, the compressed gas is evolved from a pores storage material or from a desirable chemical reaction.

As exemplified in certain embodiments described above, any ancillary portion of a support device can be arranged to move in conjunction with an adjustable back. Thus, the apparatus can be arranged so that arm supports move in conjunction with (whether fixedly or variably) a back support portion. Also, various other features such as, for example, a work surface, a trackball, a mouse, or other system features can be arranged to move in an advantageous manner.

Having reviewed the disclosure provided above, along with the accompanying figures, one of skill in the art will appreciate the value and novelty of the present invention; including the value of having a back support device adapted to adjust and provide continuous therapeutic back support so that a user's spine is maintained in an upright position, with a desirable orientation and curvature, despite the movements of the user. In particular, it will be seen that there is benefit in providing a back support portion that advances substantially towards a user's back while maintaining a correct orientation and contour as the user moves forward, and thereafter provides effective therapeutic support against the user's back as the user leans back, maintaining an upright posture and reducing fatigue. Also there is benefit in providing a back support that maintains a particular angular orientation as it moves towards a user.

While the invention has been described in detail in connection with the presently preferred embodiments, it should be readily understood that the invention is not limited to such disclosed embodiments. Rather, the invention can be modified to incorporate any number of variations, alterations, substitutions, or equivalent arrangements not heretofore described, but which are commensurate with the spirit and scope of the invention. Accordingly, the invention is not to be seen as limited by the foregoing description, but is only limited by the scope of the appended claims.

The invention claimed is:

1. A chair comprising:

a seat portion;

a support member;

a back support portion; and an active device disposed between said support member and said back support portion, said active device being controlled by a controller, said controller being adapted to detect when a user has moved forward with respect to said support member and operate said active device to move said back support portion forward with respect to said support member.

2. A chair as defined in claim 1 wherein said active device is disposed within a telescopic enclosure.

3. A chair as defined in claim 1 wherein said controller receives information from a sensor.

4. A chair as defined in claim 1 wherein said controller includes a processor.

* * * * *